US006863459B2

(12) United States Patent
Ikeno et al.

(10) Patent No.: US 6,863,459 B2
(45) Date of Patent: Mar. 8, 2005

(54) MEDIUM-EDGE SETTING DEVICE AND IMAGE FORMING APPARATUS

(75) Inventors: Takahiro Ikeno, Owariasahi (JP); Tadahiro Kunii, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/724,227

(22) Filed: Dec. 1, 2003

(65) Prior Publication Data

US 2004/0109718 A1 Jun. 10, 2004

(30) Foreign Application Priority Data

Nov. 29, 2002 (JP) ..... 2002-348270
Nov. 29, 2002 (JP) ..... 2002-348271

(51) Int. Cl.[7] ..... B41J 11/44

(52) U.S. Cl. ..... 400/708; 400/61; 400/70; 400/74; 400/76

(58) Field of Search ..... 400/708, 76, 74, 400/70, 61

(56) References Cited

U.S. PATENT DOCUMENTS 4,647,950 A * 3/1987 Nosaki et al. ..... 347/246
5,604,568 A * 2/1997 Iwama ..... 399/215
2003/0068181 A1 * 4/2003 Miyata et al. ..... 399/394
2003/0080487 A1 * 5/2003 Tamura et al. ..... 270/58.07

FOREIGN PATENT DOCUMENTS

DE 3919796 A * 2/1990 ..... B32B/31/00
EP 0 526 154 A2 3/1993
JP A 3-7371 1/1991
JP A 5-32026 2/1993
JP A 6-32032 2/1994
JP A 6-64285 3/1994
JP B2 7-108593 11/1995
JP B2 2907597 4/1999

OTHER PUBLICATIONS

IBM Technical Disclosure, vol. 24, Issue No. 1B, pp. 602–606, Jun. 1981.*

* cited by examiner

*Primary Examiner*—Charles H. Nolan, Jr.
(74) *Attorney, Agent, or Firm*—Oliff & Berridge, PLC

(57) ABSTRACT

A medium-edge setting device detects edges of a paper (S110) and acquires data for left and right edge candidate positions (S120). The medium-edge setting device determines whether the difference between left and right center-edge distances is less than or equal to a predetermined value (S150). If so (S150: YES), the right edge position is set to the right edge candidate position and the left edge position is set to the left edge candidate position (S160). If not (S150: NO), the paper is conveyed a predetermined amount (S190) and the paper edge detection is repeated. If the repetitions of the paper-edge detecting process exceed a predetermined number (S180: NO), then the larger of the left and right center-edge distances is set as the distance from the center of the paper to each edge position, and the left and right edge positions are set according to this distance (S200, S210, S220).

21 Claims, 11 Drawing Sheets

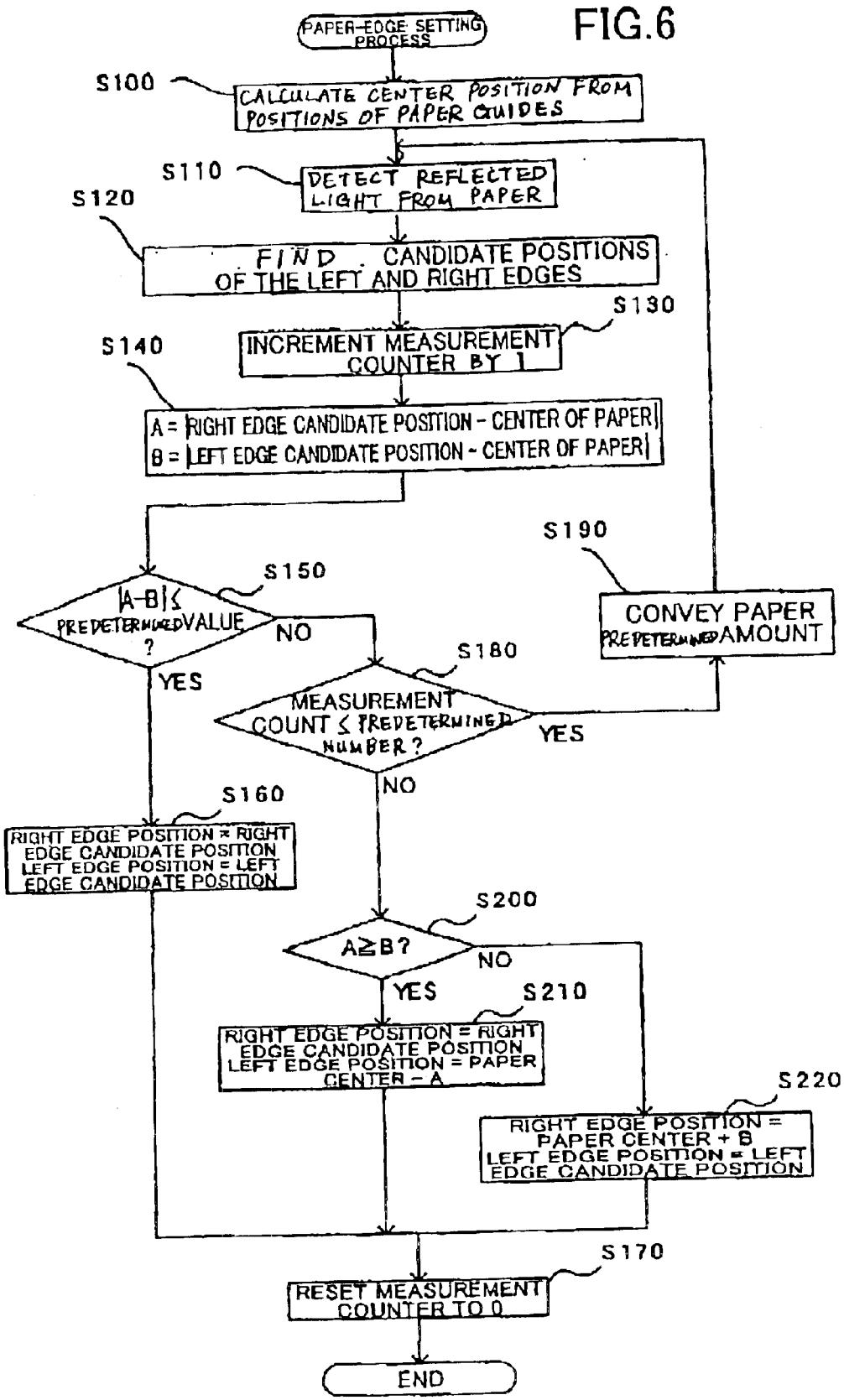
FIG.6
PAPER-EDGE SETTING PROCESS
S100
CALCULATE CENTER POSITION FROM POSITIONS OF PAPER GUIDES
S110
DETECT REFLECTED LIGHT FROM PAPER
S120
FIND CANDIDATE POSITIONS OF THE LEFT AND RIGHT EDGES
S130
INCREMENT MEASUREMENT COUNTER BY 1
S140
A = |RIGHT EDGE CANDIDATE POSITION - CENTER OF PAPER|
B = |LEFT EDGE CANDIDATE POSITION - CENTER OF PAPER|
S150
|A-B| ≤ PREDETERMINED VALUE ?
NO
YES
S180
MEASUREMENT COUNT ≤ PREDETERMINED NUMBER ?
YES
NO
S190
CONVEY PAPER PREDETERMINED AMOUNT
S160
RIGHT EDGE POSITION = RIGHT EDGE CANDIDATE POSITION
LEFT EDGE POSITION = LEFT EDGE CANDIDATE POSITION
S200
A≧B ?
NO
YES
S210
RIGHT EDGE POSITION = RIGHT EDGE CANDIDATE POSITION
LEFT EDGE POSITION = PAPER CENTER - A
S220
RIGHT EDGE POSITION = PAPER CENTER + B
LEFT EDGE POSITION = LEFT EDGE CANDIDATE POSITION
S170
RESET MEASUREMENT COUNTER TO 0
END

MEDIUM-EDGE SETTING DEVICE AND IMAGE FORMING APPARATUS

BACKGROUND OF THE INVENTION

1. Field of the Invention

The present invention relates to a medium-edge setting device for setting edge positions of a paper and an image forming apparatus, such as a photocopier, printer, or the like employing the medium-edge setting device.

2. Description of Related Art

A medium-edge setting device for detecting both side edge positions of a medium such as that disclosed in Japanese Patent No. 2907597 is well known in the art. This medium-edge setting device includes an optical sensor having a light-emitting unit (light-emitting element) and a light-receiving unit (light-receiving element) and detects both side edges of a medium while the optical sensor moves reciprocally in the widthwise direction of the medium.

In this medium-edge setting device, the optical sensor is mounted on a carriage that travels reciprocally in the widthwise direction of the medium. In order to detect the edge positions of the medium, the optical sensor samples the amount of light reflected from the medium while the carriage moves from one edge of the medium to the other. A threshold value for determining the existence of the medium is set based on the difference in output from the optical sensor at a position in which the medium is present and a position in which the medium is not present. The optical sensor again detects the amount of light reflected from the medium as the carriage returns in the opposite direction, and both side edges of the medium are detected by comparing the amount of reflected light detected by the optical sensor with the threshold value set above. In this way, the medium-edge setting device detects the edge positions of a medium.

However, the medium-edge setting device described above sets a single threshold value based on amounts of reflected light sampled by the optical sensor and uses this single threshold value for detecting both the left edge and the right edge. Accordingly, when the left and right edges of a medium have different shades of color or reflectance due to soiled or yellowed areas on the medium, for example, or when the medium has been preprinted with characters or images, the medium-edge setting device described above is susceptible to errors in detecting the left and right edges and may have difficulty detecting the edge positions with accuracy.

Another example is disclosed in Japanese patent application publication No. HEI-3-7371. An optical sensor is mounted on the carriage of an image forming apparatus. As the carriage is moved from one widthwise side of the paper to the other, the optical sensor irradiates light onto the paper and detects the amount of light reflected therefrom in order to detect the edges of the paper.

SUMMARY OF THE INVENTION

However, when parts of the paper are soiled or contain graphics or the like, it has not been possible to accurately set both edges of the paper. When a paper P has a low reflectance part 105, such as a soiled area or graphics, as shown in FIG. 1(*a*), and when a detecting means for detecting the edge of the paper P is moved from the left edge to the right edge of the paper P, the amount of reflected light changes from a LOW level to a HIGH level at a position P1 and subsequently changes from the HIGH level to the LOW level at a position P2. While the position P1 is in fact the left edge of the paper P and the position P1 is set as the left edge position, the right edge position of the paper P is actually a position P3. However, the right edge position is mistakenly set to the position P2.

In view of the foregoing, it is an object of the present invention to provide a medium-edge setting device capable of accurately setting the edge positions of a paper or other medium without being affected by soiled areas, graphics, or the like thereon. It is another object of the present invention to provide an image forming apparatus employing the medium-edge setting device.

In order to attain the above and other objects, the present invention provides a medium-edge setting device for a medium having side edges and a width in a widthwise direction. The medium-edge setting device includes a detecting unit, a distance calculating unit, and an edge setting unit. The detecting unit is movable in a widthwise direction of a medium. The detecting unit detects at least one of side edges of the medium and determines candidate edge positions of at least one of the side edges. The distance calculating unit calculates at least one center-edge distance. The center-edge distance is a distance between a predetermined center position of the medium in the widthwise direction and the candidate edge positions of at least one of the side edges. The edge setting unit determines edge positions of the side edges based on the at least one center-edge distance and the predetermined center position.

The present invention also provides a medium-edge setting device for a medium having a width in a widthwise direction. The medium has a first side edge and a second side edge. The medium-edge setting device includes a detecting unit, a distance calculating unit, a distance-difference judging unit, a conveying unit, an edge setting unit, a detecting unit, a distance calculating unit, a distance-difference judging unit, a conveying unit, and an edge setting unit. The detecting unit is movable in a widthwise direction of a medium. The detecting unit detects first and second side edges of the medium to determine a first candidate edge position and a second candidate edge position of the first and second side edges. The distance calculating unit calculates a first center-edge distance and a second center-edge distance. The first center-edge distance is a distance between a predetermined center position of the medium in the widthwise direction and the first candidate edge position. The second center-edge distance is a distance between the predetermined center position and the second candidate edge position. A distance difference is a difference between the first center-edge distance and the second center-edge distance. A longer center-edge distance is a longer one of the first center-edge distance and the second center-edge distance. The distance-difference judging unit judges whether the distance difference is less than or equal to a first predetermined value. The conveying unit conveys the medium in a direction substantially orthogonal to the widthwise direction. The edge setting unit sets the first candidate edge position and the second candidate edge position as the first edge position and the second edge position, respectively, when the distance-difference judging unit determines that the distance difference is less than or equal to the first predetermined value, and controls the conveying unit to convey the medium a predetermined distance and subsequently controls the detecting unit to detect the first side edge and the second side edge, when the distance-difference judging unit determines that the distance difference is greater than the first predetermined value.

The present invention also provides an image forming apparatus. The image forming apparatus includes an image forming unit and a medium-edge setting device for a medium having side edges and a width in a widthwise direction. The medium-edge setting device includes a detecting unit, a distance calculating unit, and an edge setting unit. The detecting unit is movable in a widthwise direction of a medium. The detecting unit detects at least one of side edges of the medium and determines candidate edge positions of at least one of the side edges. The distance calculating unit calculates at least one center-edge distance. The center-edge distance is a distance between a predetermined center position of the medium in the widthwise direction and the candidate edge positions of at least one of the side edges. The edge setting unit determines edge positions of the side edges based on the at least one center-edge distance and the predetermined center position. The image forming unit forms images on the medium based on the edge positions determined by the medium-edge setting device.

The present invention also provides a medium-edge setting device for a medium having a width in a widthwise direction: The medium-edge setting device includes a reflected-light detecting unit, a threshold setting unit, and an edge-position determining unit. The reflected-light detecting unit is movable in a widthwise direction of a medium. The reflected-light detecting unit detects amounts of reflected light that is reflected from the medium. The medium has a first side edge and a second side edge. A first region includes a region that is nearer to the first side edge than to the second side edge. A second region includes another region that is nearer to the second side edge than to the first side edge. The threshold setting unit sets a first threshold value for determining a first edge position of the first side edge based on the amounts of reflected light that is detected from the first region on the medium, and sets a second threshold value for determining a second edge position of the second side edge based on the amounts of reflected light that is detected from the second region on the medium. The edge-position determining unit compares the amounts of reflected light that is detected from a region including the first side edge with the first threshold value and compares the amounts of reflected light that is detected from another region including the second side edge with the second threshold value. The amounts of reflected light are detected by the reflected-light detecting unit. Accordingly, the edge-position determining unit determines the first and second edge positions of the medium.

The present invention also provides an image forming apparatus. The image forming apparatus includes an image forming unit and a medium-edge setting device for a medium having a width in a widthwise direction. The medium-edge setting device includes a reflected-light detecting unit, a threshold setting unit, and an edge-position determining unit. The reflected-light detecting unit is movable in a widthwise direction of a medium. The reflected-light detecting unit detects amounts of reflected light that is reflected from the medium. The medium has a first side edge and a second side edge. A first region includes a region that is nearer to the first side edge than to the second side edge. A second region includes another region that is nearer to the second side edge than to the first side edge. The threshold setting unit sets a first threshold value for determining a first edge position of the first side edge based on the amounts of reflected light that is detected from the first region on the medium, and sets a second threshold value for determining a second edge position of the second side edge based on the amounts of reflected light that is detected from the second region on the medium. The edge-position determining unit compares the amounts of reflected light that is detected from a region including the first side edge with the first threshold value and compares the amounts of reflected light that is detected from another region including the second side edge with the second threshold value. The amounts of reflected light are detected by the reflected-light detecting unit. Accordingly, the edge-position determining unit determines the first and second edge positions of the medium. The image forming unit moves in the widthwise direction of the medium and forms images thereon based on the first and second edge positions determined by the medium-edge setting device.

BRIEF DESCRIPTION OF THE DRAWINGS

The above and other objects, features and advantages of the invention will become more apparent from reading the following description of the preferred embodiments taken in connection with the accompanying drawings in which:

FIG. 1(*b*) is another explanatory diagram showing problems in detecting side edges of a paper;

FIG. 6 is a flowchart showing steps for setting side edges of a paper according to the first embodiment;

DETAILED DESCRIPTION OF THE PREFERRED EMBODIMENTS

Figure 1A:
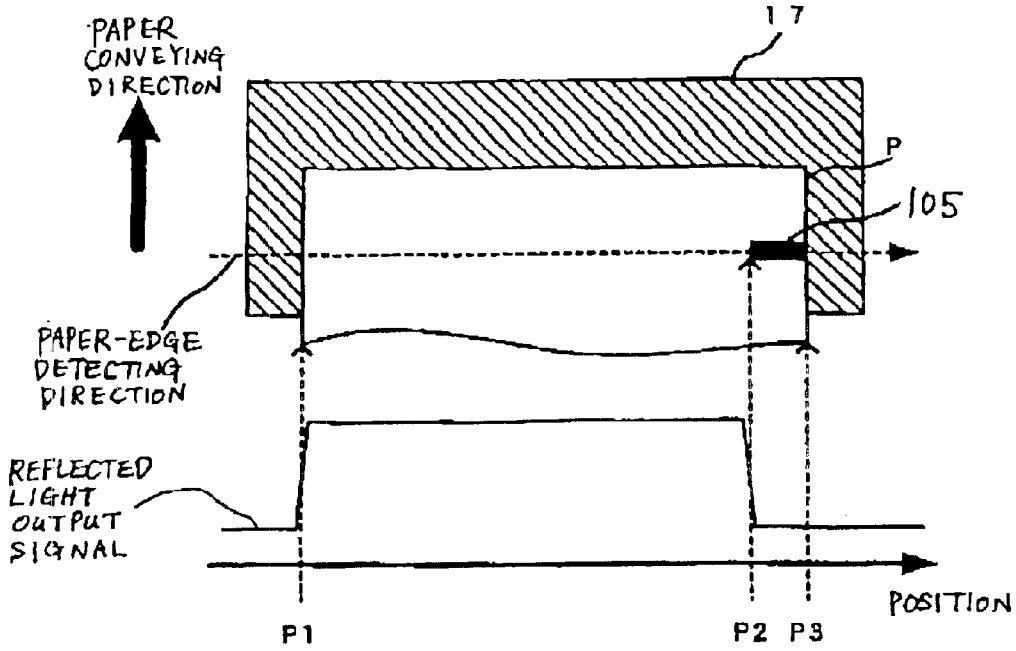
FIG. 1(*a*) is an explanatory diagram showing problems in detecting side edges of a paper.

A medium-edge setting device and an image forming apparatus according to preferred embodiments of the present invention will be described while referring to the accompanying drawings wherein like parts and components are designated by the same reference numerals to avoid duplicating description.

First Embodiment

Figure 2:
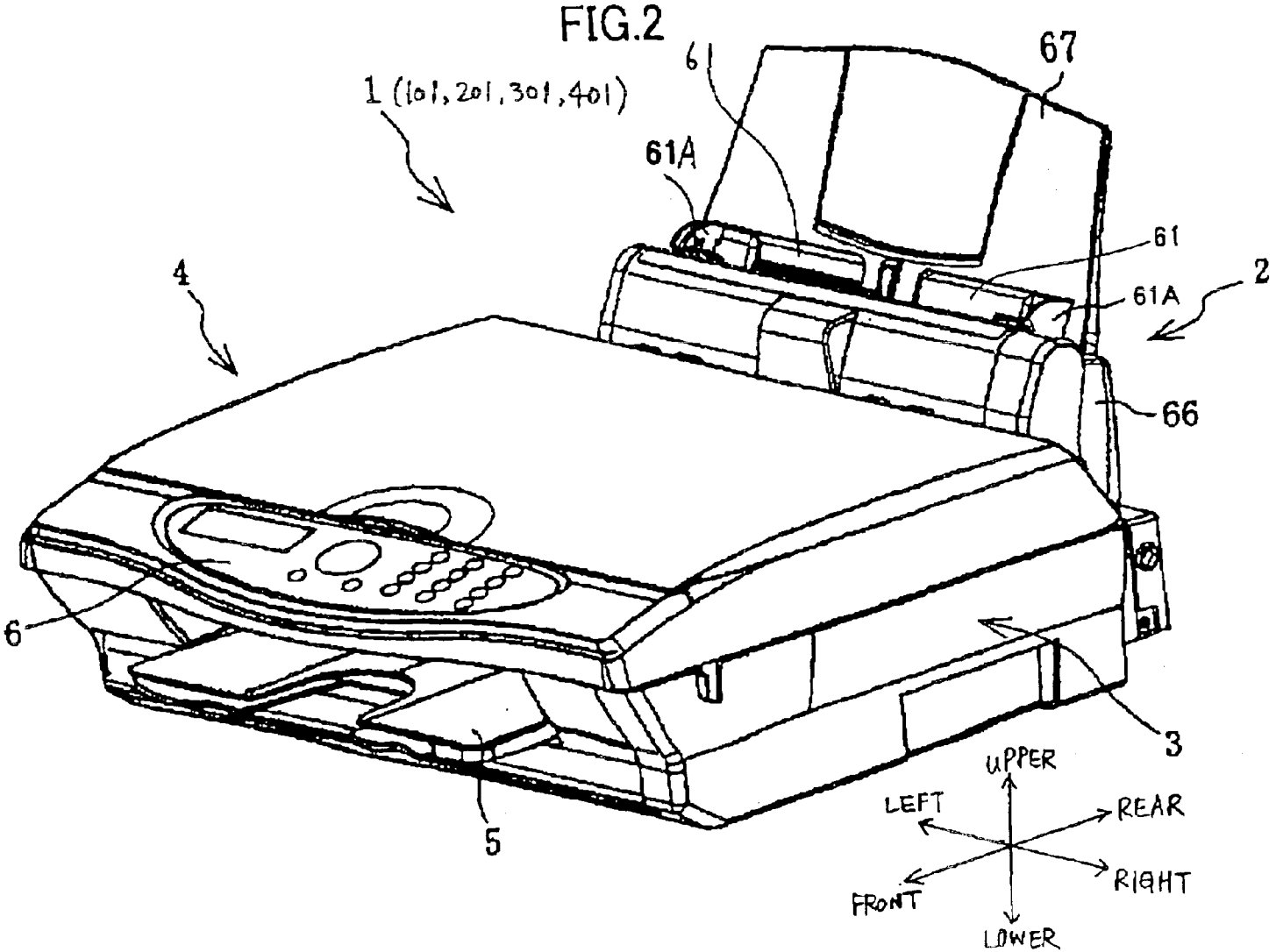
FIG. 2 is a perspective view showing a multifunction device according to first to fifth embodiments of the present invention.

FIG. 2 is a perspective view of a multifunction device 1 according to a first embodiment. The multifunction device 1 has a printer function, a copier function, a scanner function, a facsimile function, a telephone function, and the like.

As shown in FIG. 2, a paper supplying unit 2 is provided in the rear section of the multifunction device 1. An inkjet printer 3 is provided in front of and below the paper supplying unit 2. A scanning unit 4 for implementing the copier function and facsimile function is provided above the printer 3. A discharge tray 5 is provided on the front side of the printer 3. An operating panel 6 is provided on the top surface on the front end of the scanning unit 4.

The paper supplying unit 2 includes a sloped wall section 66 for maintaining paper in a sloped posture, and a paper guide plate 67 detachably mounted on the wall section 66. A plurality of sheets of paper can be stacked in the paper supplying unit 2. A pair of paper guides 61 is provided on a paper-loading surface of the sloped wall section 66 for guiding paper at a predetermined position.

The paper guides 61 can be adjusted according to the width dimension of the paper P loaded between the paper guides 61 for guiding the paper P by the left and right edges thereof and for setting the paper P in the widthwise center on the paper loading surface of the sloped wall section 66.

A paper guide position sensor 64 (see FIG. 5) is disposed on each of the paper guides 61. The paper guide position sensors 64 are configured of a potentiometer, for example, and detect the positions of the paper guides 61 based on a distance from a reference position. The distance from the reference position to an origin position of the carriage 11 is predetermined. The origin position of the carriage 11 is a position at which the carriage 11 is initially located.

A paper feed motor (not shown), a feeding roller (not shown), and the like are built into the wall section 66. When driven to rotate by the paper feed motor, the feeding roller conveys a sheet of paper toward the printer 3.

Figure 3:
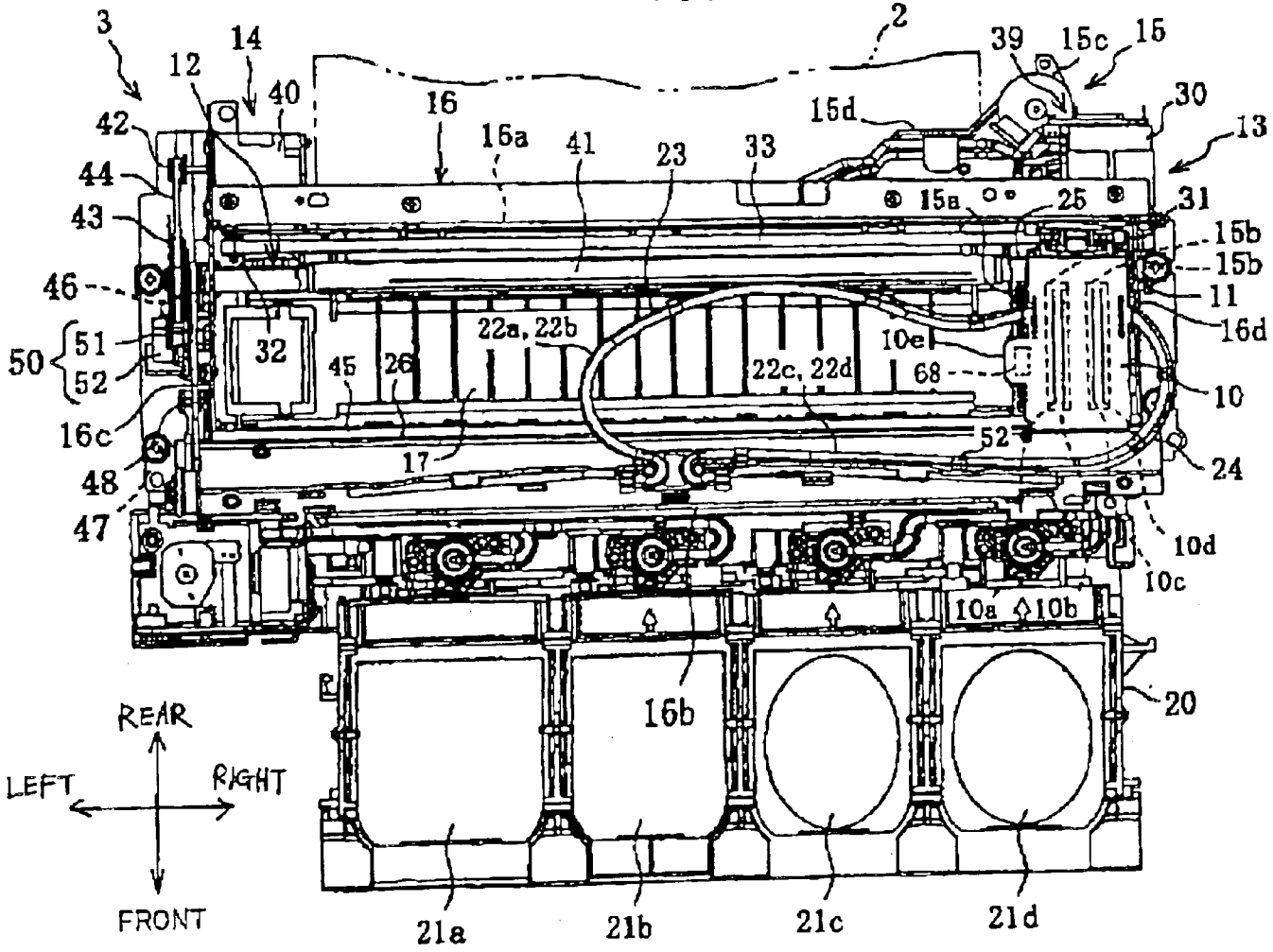
FIG. 3 is a plan view showing internal construction of a printer provided in the multifunction device in FIG. 2.

Next the printer 3 will be described in greater detail. FIG. 3 is a plan view showing the internal construction of the printer 3.

As shown in FIG. 3, the printer 3 includes a print head 10, a carriage 11, a guide mechanism 12, a carriage moving mechanism 13, a paper conveying mechanism 14, and a maintenance mechanism 15 for the print head 10. The print head 10 is mounted on the carriage 11. The guide mechanism 12 supports and guides the carriage 11 so that the carriage 11 can move reciprocally in a scanning direction, which is the left-to-right direction in FIG. 3. The carriage moving mechanism 13 moves the carriage 11 in the left-to-right direction. The paper conveying mechanism 14 conveys paper supplied by the paper supplying unit 2.

A rectangular frame 16 that is long in the left-to-right direction and that is short in the front-to-rear direction is provided in the printer 3. Various components are mounted on the rectangular frame 16, including the guide mechanism 12, carriage moving mechanism 13, paper conveying mechanism 14, and maintenance mechanism 15. The print head 10 and carriage 11 are also accommodated inside the rectangular frame 16 so as to be capable of moving reciprocally in the left-to-right direction.

The rectangular frame 16 includes a rear plate 16*a* and a front plate 16*b*. A paper introducing opening (not shown) and paper discharging opening (not shown) are formed in the rear plate 16*a* and front plate 16*b*, respectively. Paper supplied by the paper supplying unit 2 is introduced into the rectangular frame 16 via the paper introducing opening, conveyed to the front of the rectangular frame 16 by the paper conveying mechanism 14, and discharged through the paper discharging opening onto the discharge tray 5 (FIG. 2) on the front of the multifunction device 1. A black platen 17 having a plurality of ribs is mounted on the bottom surface of the rectangular frame 16. The print head 10 performs a printing operation on paper inside the rectangular frame 16 as the paper moves over the black platen 17.

The print head 10 is provided with four sets of ink nozzles 10*a*–10*d* that point downward, that is, in a direction toward the back side of the drawing sheet. Paper is printed on by ejecting four colors (black, cyan, yellow, and magenta) of ink downward through the four sets of ink nozzles 10*a*–10*d*. Since the four sets of ink nozzles 10*a*–10*d* are disposed on the bottom side of the print head 10, their positions are represented by broken lines in FIG. 3.

Ink cartridges 21*a*–21*d* for each of the four colors are mounted in a cartridge holder 20 on the front side of the rectangular frame 16. The ink cartridges 21*a*–21*d* are connected to the print head 10 via four flexible ink tubes 22*a*–22*d* that pass through the rectangular frame 16 in order to supply ink of each of the four colors to the print head 10.

Left and right flexible printed circuits (FPC) 23 and 24 are disposed inside the rectangular frame 16. The left FPC 23 extends together with the flexible ink tube 22*a* and flexible ink tube 22*b* and connects to the print head 10. The right FPC 24 extends together with the flexible ink tube 22*c* and flexible ink tube 22*d* and connects to the print head 10. The left FPC 23 and right FPC 24 include a plurality of signal lines that electrically connect the print head 10 to a control unit 70 (FIG. 5) described later.

The guide mechanism 12 has a guide shaft 25 and a guide rail 26. The guide shaft 25 extends left-to-right in the rear part of the rectangular frame 16. The left and right ends of the guide shaft 25 are coupled with a left plate 16*c* and a right plate 16*d*, respectively, of the rectangular frame 16. The guide rail 26 extends left-to-right in the front part of the rectangular frame 16. The rear end of the carriage 11 is fitted over the guide shaft 25 so as to be capable of sliding along the same, while the front end of the carriage 11 is engaged with the guide rail 26 and capable of sliding along the same.

The carriage moving mechanism 13 includes a carriage motor 30, a drive pulley 31, a follow pulley 32, and a belt 33. The carriage motor 30 is mounted on the rectangular frame 16 at the rear side of the rear plate 16*a* on the right end and facing front. The drive pulley 31 is rotatably supported on the right end of the rear plate 16*a* and is driven to rotate by the carriage motor 30. The follow pulley 32 is rotatably supported on the left end of the rear plate 16*a*. The belt 33 is looped around the pulleys 31 and 32 and fixed to the carriage 11. A carriage conveyance encoder 39 is disposed near the carriage motor 30 for detecting movement (position) of the carriage 11 (print head 10).

The paper conveying mechanism 14 includes a paper conveying motor 40, a registration roller 41, a drive pulley 42, a follow pulley 43, and a belt 44. The paper conveying motor 40 is mounted facing leftward on the portion of the left plate 16*c* that protrudes further rearward than the rear plate 16*a*. The registration roller 41 extends in the left-to-right direction in the rectangular frame 16 below the guide shaft 25. The left and right ends of the registration roller 41 are rotatably supported in the left plate 16*c* and right plate 16*d*, respectively. The drive pulley 42 is driven to rotate by the paper conveying motor 40. The follow pulley 43 is coupled to the left end of the registration roller 41. The belt 44 is looped around the pulleys 42 and 43. When the paper conveying motor 40 is driven, the registration roller 41 rotates and conveys paper in the rear-to-front direction. While the registration roller 41 is emphasized in FIG. 3, the registration roller 41 is actually disposed beneath the guide shaft 25.

The paper conveying mechanism 14 further includes a discharge roller 45, a follow pulley 46, a follow pulley 47, and a belt 48. The discharge roller 45 extends in the left-to-right direction in the front section of the rectangular frame 16. The left and right ends of the discharge roller 45 are rotatably supported in the left plate 16*c* and right plate 16*d*, respectively. The follow pulley 46 is integrally provided with the follow pulley 43. The follow pulley 47 is coupled to the left end of the discharge roller 45. The belt 48 is looped around the pulleys 46 and 47. When the paper conveying motor 40 is driven, the discharge roller 45 rotates and discharges paper toward the discharge tray 5 (FIG. 2) in the front of the multifunction device 1.

An encoder disk 51 is fixed to the follow pulley 43. A photo interrupter 52 having a light-emitting unit and a light-receiving unit (not shown) is mounted on the left plate 16*c* such that the encoder disk 51 is interposed between the light-emitting unit and light-receiving unit. The encoder disk 51 and photo interrupter 52 together make is up a paper conveying encoder 50. The control unit 70 described later controls the driving of the paper conveying motor 40 based on detection signals from the paper conveying encoder 50 (more specifically, from the photo interrupter 52).

The maintenance mechanism 15 includes a wiper 15*a*, two caps 15*b*, and a drive motor 15*c*. The wiper 15*a* wipes the surface of the print head 10. Each of the caps 15*b* can hermetically seal two sets of the ink nozzles 10*a*–10*d*. The drive motor 15*c* drives both of the wiper 15*a* and caps 15*b*. The wiper 15*a*, caps 15*b*, and drive motor 15*c* are mounted on a mounting plate 15*d*. The mounting plate 15*d* is fixed to the lower surface side of the bottom plate of the rectangular frame 16 in the right portion thereof. Since the caps 15*b* are disposed on the bottom side of the print head 10, dotted lines indicate the positions of the caps 15*b* on the opposite side in FIG. 3.

Figure 4:
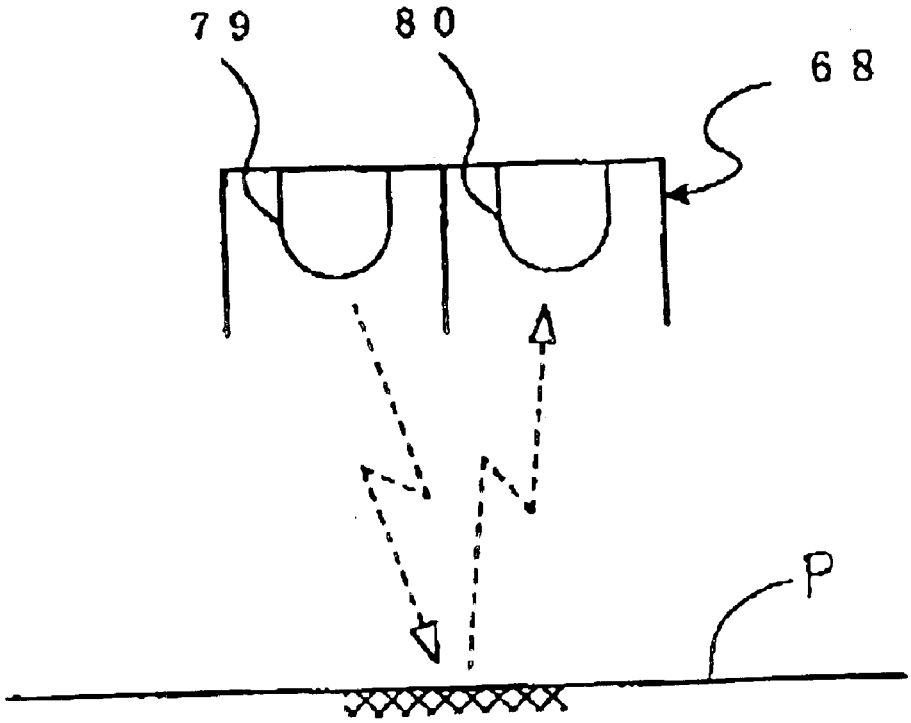
FIG. 4 is an explanatory diagram showing a media sensor provided in the printer in FIG. 3.

A sensor mounting unit 10*e* protrudes from the left side of the print head 10. A media sensor 68 is mounted on the sensor mounting unit 10*e* for detecting the leading edge, trailing edge, and side edges of the paper P. Accordingly, the media sensor 68 moves together with the print head 10 along a moving path that extends in the widthwise direction. As shown in FIG. 4, the media sensor 68 is a reflection-type optical sensor that includes a light-emitting element 79 (light-emitting diode in the embodiment) and a light-receiving element 80 (phototransistor in the embodiment). The light-emitting element 79 emits light. When the paper P is not present below the media sensor 68, the light is reflected at the black platen 17 and is received by the light-receiving element 80. The amount of light received by the light-receiving element 80 approaches a value of zero (0). When the paper P is present below the media sensor 68, the light-receiving element 80 receives a much larger amount of reflected light from the paper P than when the paper P is absent below the media sensor 68. This is because the paper P is generally white in color. Hence, the output value from the media sensor 68 (specifically, the voltage outputted by the light-receiving element 80) is at a HIGH level when the paper P is present below the media sensor 68 and at a LOW level when the paper P is not present below the media sensor 68.

In addition, a registration sensor 69 (see FIG. 5) is disposed upstream (rearward) of the media sensor 68 in the paper conveying direction (rear-to-front direction), as the upstream sensor, for detecting the existence of paper and the leading edge and trailing edge of the paper. More specifically, the registration sensor 69 is mounted in the front end of a top cover provided in the paper supplying unit 2 that forms a conveying path in the paper supplying unit 2.

The registration sensor 69 can be configured, for example, by a mechanical sensor having a probe, a photo interrupter, and a torsion spring (not shown). The probe protrudes into the paper conveying path and rotates when contacted by the paper. The photo interrupter includes a light-emitting unit and a light-receiving unit for detecting rotation of the probe. The torsion spring urges the probe into the paper conveying path. A shielding part is integrally provided on the probe. When the probe is rotated by contact from paper, the shielding part becomes positioned in regions outside the area between the light-emitting unit and the light-receiving unit of the photo interrupter. Therefore, when light is transmitted from the light-emitting unit to the light-receiving unit, the registration sensor 69 is in an ON state. Since the probe is urged into the paper conveying path by the torsion spring when paper is not being conveyed, the shielding part becomes positioned between the light-emitting unit and light-receiving unit of the photo interrupter at this time. Hence, the shielding part interrupts the transmission of light from the light-emitting unit to the light-receiving unit, placing the registration sensor 69 in an OFF state.

Figure 5:
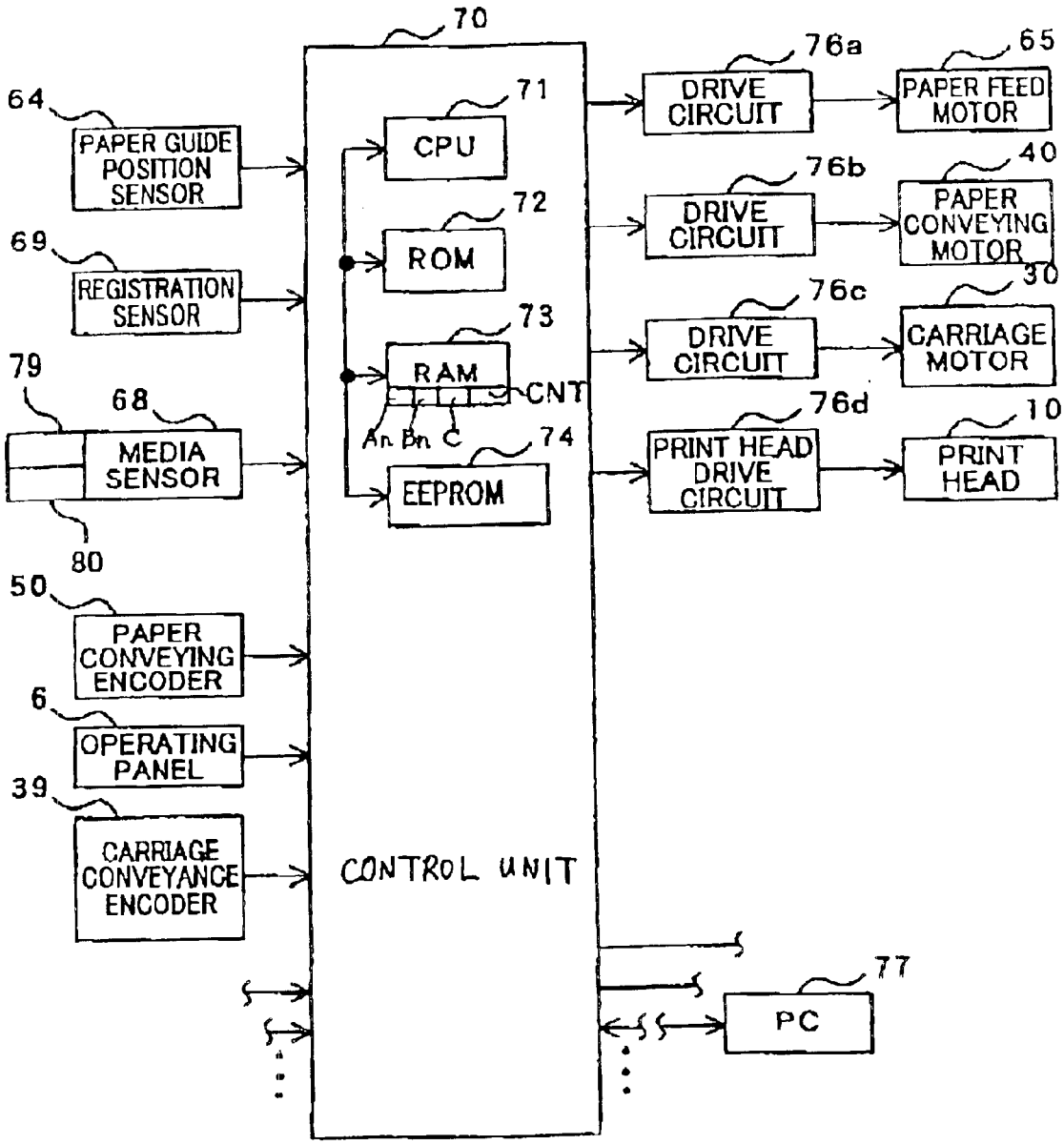
FIG. 5 is a block diagram showing a control unit according to the first to fifth embodiments.

Next, the control unit 70 will be described in greater detail. FIG. 5 is a block diagram showing the electric configuration of the control unit 70.

As shown in FIG. 5, the control unit 70 includes a microcomputer having a CPU 71, a ROM 72, a RAM 73, and an EEPROM 74. The paper guide position sensors 64, the registration sensor 69, media sensor 68, paper conveying encoder 50, operating panel 6, carriage conveyance encoder 39, and the like are electrically connected to the control unit 70.

Also electrically connected to the control unit 70 are drive circuits 76*a*–76*c*, and a print head drive circuit 76*d*. The drive circuits 76*a*–76*c* drive the paper feed motor 65, the paper conveying motor 40, and the carriage motor 30, respectively. The print head drive circuit 76*d* drives the print head 10. The control unit 70 is also capable of being connected to a personal computer 77.

Based on results from the media sensor 68 for detecting the paper P, the control unit 70 outputs a carriage control command signal to the carriage moving mechanism 13 for moving the relative position of the carriage 11 and the paper P closer to a target relative position based on the printing content. The carriage moving mechanism 13 drives the carriage motor 30 based on the received carriage control command signals in order to move the carriage 11 reciprocally along the guide shaft 25 so that the relative position of the carriage 11 and the paper P approach the target relative position.

The CPU 71 temporarily stores print data received from the personal computer 77 in the RAM 73 and subsequently performs a process according to programs stored in the ROM 72 to convert the print data stored in the RAM 73 into image data.

The CPU 71 detects both side edges of the paper based on detection signals from the registration sensor 69, the media sensor 68, the paper conveying encoder 50, and the carriage conveyance encoder 39.

Next, a paper-edge setting process executed by the control unit 70 will be described with reference to FIG. 6. FIG. 6 is a flowchart showing steps in the paper-edge setting process.

At the beginning of the paper-edge setting process in S100, the control unit 70 acquires data for the center position of the paper. To acquire data for the center position of the paper, the control unit 70 calculates the center position from the positions in which the paper guides 61 are set, as detected by the paper guide position sensors 64. An absolute distance from the origin position of the carriage 11 to each of the paper guides 61 can be acquired from the paper guide position sensors 64. Accordingly, the average position (middle position) of the paper guides 61 is set as the center position of the paper.

In S110 a paper-edge detecting process is performed. After the carriage 11 has been moved to the left edge of the paper P, the light-emitting element 79 in the media sensor 68 irradiates light onto the paper P while the carriage 11 is moving to the right. The light-receiving element 80 detects the amount of reflected light received from the paper P. As the carriage 11 moves from the left edge to the right edge of the paper P, positional data for the carriage 11 detected by the carriage conveyance encoder 39 and data for the amount of light reflected at these positions, that is, output values (voltages) from the media sensor 68 are accumulated in the RAM 73.

In S120 the CPU 71 finds the positions at which the amount of reflected light changes from LOW level to HIGH level or from HIGH level to LOW level, based on the data stored in the RAM 73. A candidate position for the left edge of the paper P is set to the position at which the amount of light changes from LOW level to HIGH level. When the CPU 71 finds a plurality of positions at which the amount of light changes from LOW level to HIGH level, the farthest position from the center position of the paper is set as the candidate position for the left edge. Similarly, a candidate position for the right edge of the paper P is set to the position at which the amount of light changes from HIGH level to LOW level. When the CPU 71 finds a plurality of positions at which the amount of light changes from HIGH level to LOW level, the farthest position from the center position of the paper is set as the candidate position for the right edge.

Figure 1B:
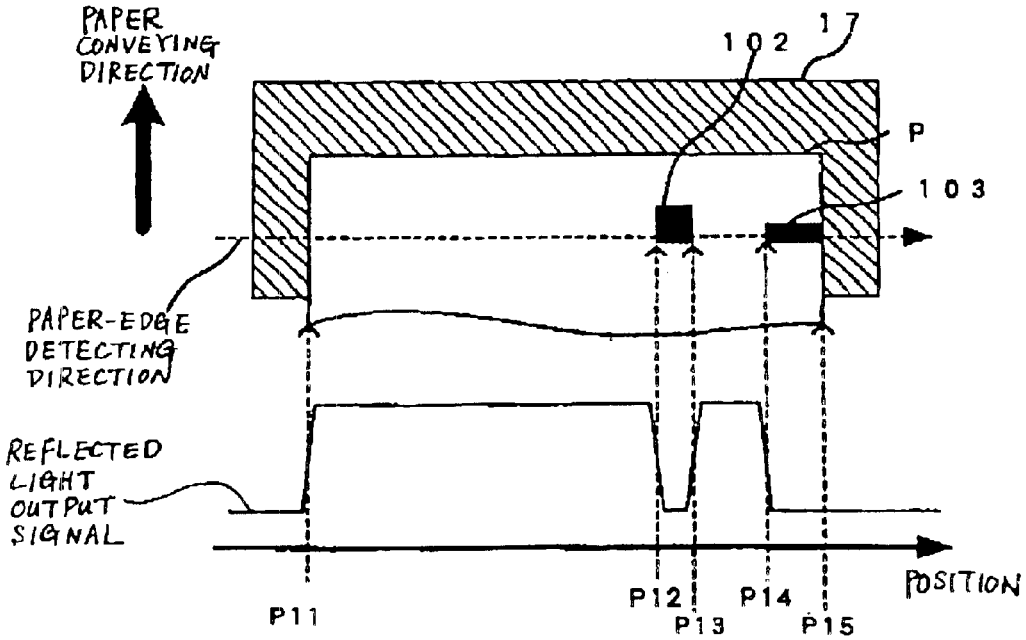

Here, we will consider a low reflectance part 102 on an interior portion of the paper P and a low reflectance part 103 on an edge of the paper P, as shown in FIG. 1(*b*). The amount of reflected light first changes from a LOW level to a HIGH level at a position P11. At a position P12, the light first changes from a HIGH level to a LOW level. At a position P13, the amount of light changes again from LOW level to HIGH level. At a position P14, the amount of reflected light changes from a HIGH level to a LOW level for the last time. It is possible that the left edge would be set to the position P11 and the right edge to the position P12. In the present embodiment, however, since the position farthest from the center position of the paper is selected in S120, the position P14 is set as a candidate position for the right edge. Accordingly, soiled areas, graphics, or the like on an interior portion of the paper P, rather than an edge of the paper P, will not influence how the CPU 71 finds candidate positions for the edge.

In S130 a measurement counter storage area CNT (FIG. 5) provided in the RAM 73 is incremented by 1.

In S140 the distance from the center position of the paper to the candidate position for the right edge (hereinafter referred to as a right center-edge distance; corresponding to A in FIG. 6) and the distance from the center position of the paper to the candidate position for the left edge (hereinafter referred to as a left center-edge distance; corresponding to B in FIG. 6) are calculated.

In S150 the CPU 71 determines whether the difference between the right center-edge distance and the left center-edge distance (equivalent to |A−B| in FIG. 6, |A−B| is the absolute value of A−B) is less than or equal to a predetermined value, such as 5 mm. If this difference is less than or equal to the predetermined value (S150: YES), then in S160 the CPU 71 sets the right edge position to the candidate position for the right edge and the left edge position to the candidate position for the left edge. In S170 the CPU 71 resets the value for counter storage area CNT to 0 and ends the paper-edge setting process.

However, if the difference between the right center-edge distance and the left center-edge distance is greater than the predetermined value (S150: NO), then in S180 the CPU 71 determines whether the counter storage area CNT is less than or equal to a predetermined number of times, for example, 3. If the counter storage area CNT is less than or equal to the predetermined number of times (S150: YES), then in S190 the paper P is conveyed a predetermined amount, such as 20 mm, and the CPU 71 returns to S110 and repeats the paper-edge detecting process.

However, if the counter storage area CNT is greater than the predetermined number of times (S180: NO), then in S200 the CPU 71 determines whether the right center-edge distance A is greater than or equal to the left center-edge distance B. If the right center-edge distance A is greater than or equal to the left center-edge distance B (S200: YES), then in S210 the CPU 71 sets the right edge position to the candidate position for the right edge and sets the left edge position to a position calculated by subtracting the right center-edge distance A from the center position of the paper. Subsequently, in S170 the CPU 71 resets the counter storage area CNT to 0 and ends the paper-edge setting process.

However, if the right center-edge distance A is less than the left center-edge distance B in S200 (S200: NO), then in S220 the CPU 71 sets the right edge position to a position calculated by adding the left center-edge distance B to the center position of the paper and sets the left edge position to the candidate position for the left edge. Subsequently, in S170 the CPU 71 resets the counter storage area CNT to 0 and ends the paper-edge setting process.

With the medium-edge setting device having the construction described above, when the difference between the right center-edge distance A and the left center-edge distance B is small (S150: YES), then the CPU 71 determines that the candidate positions for the right edge and the left edge have been correctly detected. Therefore, in S160 the right edge position is set to the candidate position for the right edge, while the left edge position is set to the candidate position for the left edge. However, when the difference between the right center-edge distance A and the left center-edge distance 3 is large (S150: NO), then the CPU 71 determines that the candidate position for the right edge or the left edge has been incorrectly detected due to soiled areas, graphics, or the like on the edge of the paper P. Hence, the paper is conveyed a predetermined distance in S190, and the paper-edge detecting process is repeated from S110.

If the soiled area, graphics, or the like on the edge of the paper P is moved out of the region detected in the process of S110 by conveying the paper P a predetermined distance, then the CPU 71 can accurately detect the edge positions of the paper P. If the paper-edge detecting process is repeated a number of times that exceeds the predetermined number (S180: NO), then in S200 the right center-edge distance A is compared with the left center-edge distance B. If the left center-edge distance B is larger than the right center-edge distance A (S200: NO), then the true right edge is estimated to be at a position separated the left center-edge distance B from the center of the paper. Therefore, the right edge is set to this position in S220. However, when the right center-edge distance A is larger than or equal to the left center-edge distance B (S200: YES), the true left edge is estimated to be at a position separated the right center-edge distance A from the center of the paper. Therefore, the left edge is set to this position in S210.

Therefore, if soiled areas, graphics, or the like are present on the paper P in a large part of the region for detecting amounts of reflected light in the process of S110, the edge positions can be set to values near the actual edge positions (P11 and P15 in FIG. 1(*b*)) of the paper P.

In the embodiment described above, the multifunction device 1 including the printer 3 is provided with a medium-edge setting device, thereby accurately setting edge positions of the paper P for forming images in a correct position on the paper P.

Second Embodiment

Next, a medium-edge setting device according to a second embodiment of the present invention will be described. The multifunction device 101, printer 3, and control unit 70 in the second embodiment are constructed identically to those in the first embodiment.

The multifunction device 101 according to the second embodiment differs from the multifunction device 1 of the first embodiment in the paper-edge setting process. Accordingly, descriptions of the multifunction device 101, printer 3, and control unit 70 according to the second embodiment have been omitted. The following is a description of the paper-edge setting process according to the second embodiment.

Figure 7:
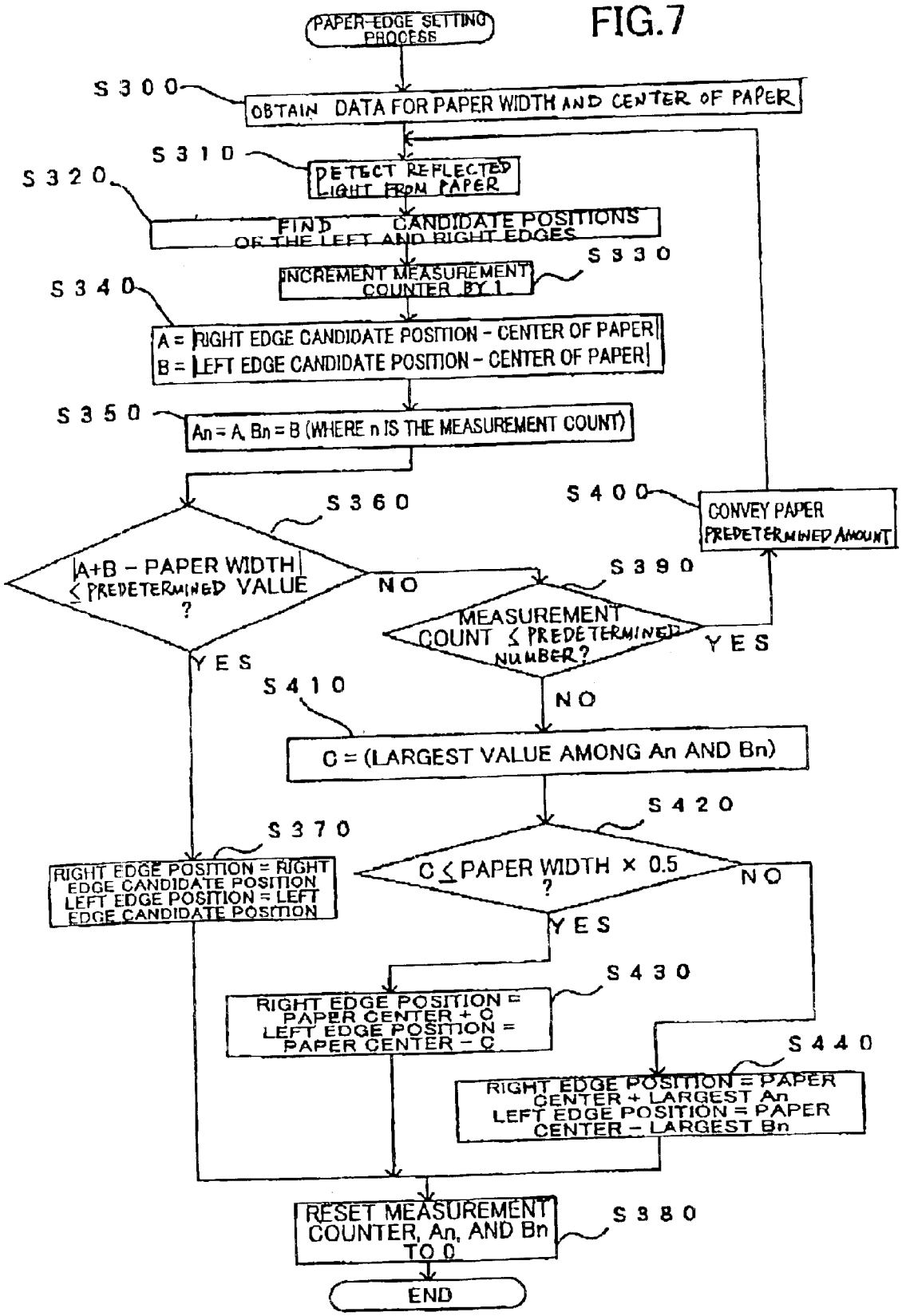
FIG. 7 is a flowchart showing steps for setting side edges of a paper according to the second embodiment.

FIG. 7 is a flowchart showing steps in a paper-edge setting process according to the second embodiment.

At the beginning of the paper-edge setting process in S300, the control unit 70 acquires data for the width of the paper and a center position of the paper. The width data is obtained from the paper guide position sensors 64 that detect the positions at which the paper guides 61 are set. The width of the paper may also be set based on paper size data received from the personal computer 77. In the second embodiment, the center position of the paper need not be the actual center position of the paper P, but may be a position that is tentatively set. In other words, the center position of the paper may be arbitrarily set to a value that does not match the actual center position of the paper P.

In S310–S330, a process identical to that in S110–S130 of the first embodiment is performed.

In S340 the distance from the predetermined center position of the paper to the candidate position for the right edge (hereinafter referred to as a right center-edge distance; corresponding to A in FIG. 7) and the distance from the center position of the paper to the candidate position for the left edge (hereinafter referred to as a left center-edge distance; corresponding to B in FIG. 7) are calculated.

In S350 the right center-edge distance is stored in a right center-edge distance storage area An, while the left center-edge distance is stored in a left center-edge distance storage area Bn, where n represents the number of measurements such that n=1, 2, 3, . . . . The right center-edge distance storage area An and left center-edge distance storage area Bn are provided in the RAM 73 (FIG. 5).

If the predetermined number of times in S390 is 3, for example, then the RAM 73 is provided with right center-edge distance storage areas A1, A2, and A3 and left center-edge distance storage areas B1, B2, and B3 for storing right edge and left center-edge distances measured three times. For example, the right center-edge distance and left center-edge distance detected in the second measurement are stored in the right center-edge distance storage area A2 and the left center-edge distance storage area B2, respectively.

In S360 the CPU 71 determines whether the difference between the sum of the right center-edge distance A and left center-edge distance B (corresponding to A+B in FIG. 7) and the width of the paper loaded in the printer 3 is less than or equal to a predetermined value, such as 5 mm. If the difference between the sum A+B and the width of the paper is less than or equal to the predetermined value (S360: YES), then in S370 the CPU 71 sets the right edge position to the candidate position for the right edge and the left edge position to the candidate position for the left edge. Subsequently, in S380 the CPU 71 sets the counter storage area CNT; the right center-edge distance storage areas A1, A2, and A3; and the left center-edge distance storage areas B1, B2, and B3 to 0 and ends the paper-edge setting process.

However, if the difference between the sum A+B and the width of the paper is determined to be greater than the predetermined value (S360: NO), then in S390 the CPU 71 determines whether the counter storage area CNT is less than or equal to the predetermined number of times, such as 3 times. If the CPU 71 determines that the counter storage area CNT is less than or equal to the predetermined number (S390: YES), then in S400 the paper P is conveyed a predetermined distance, such as 20 mm, and the CPU 71 returns to S310 to repeat the paper-edge detecting process.

However, if the CPU 71 determines that the counter storage area CNT is greater than the predetermined number of times (S390: NO), then in S410 the largest value among values in the right center-edge distance storage areas A1, A2, and A3 and values in the left center-edge distance storage areas B1, B2, and B3 is stored in a largest distance storage area C provided in the RAM 73 (FIG. 5) (corresponding to C in FIG. 7).

In S420 the CPU 71 determines whether the value in the largest distance storage area C is less than or equal to half of the paper width. If the value for largest distance storage area C is determined to be less than or equal to half of the paper width (S420: YES), then in S430 the CPU 71 sets the right edge position to a position calculated by adding the value in the largest distance storage area C to the center position of the paper, and sets the left edge position to a position calculated by subtracting the value in the largest distance storage area C from the center position of the paper. Subsequently, in S380 the CPU 71 initializes the counter storage area CNT; right center-edge distance storage areas A1, A2, and A3; and left center-edge distance storage areas B1, B2, and B3 to 0 and ends the paper-edge setting process.

On the other hand, if the value in the largest distance storage area C is determined to be greater than half of the paper width (S420: NO), then in S440 the CPU 71 sets the right edge position to a position calculated by adding the largest value among the right center-edge distance storage areas A1, A2, and A3 to the center position of the paper and sets the left edge position to a position calculated by subtracting the largest value among the left center-edge distance storage areas B1, B2, and B3 from the center position of the paper Subsequently, in S380 the CPU 71 initializes the counter storage area CNT; right center-edge distance storage areas A1, A2, and A3; and left center-edge distance storage areas B1, B2, and B3 to 0 and ends the paper-edge setting process.

With the medium-edge setting device having the construction described above, when the difference between the sum of the left center-edge distance and the right center-edge distance (A+B) and the width of the paper is small (S360: YES), then the CPU 71 determines that the candidate positions for the right edge and the left edge have been detected accurately. Accordingly, the right edge position and the left edge position are set to these candidate positions in S370. However, if the difference between the sum of distances (A+B) and the paper width is great (S360: NO), then the CPU 71 determines that the candidate positions for the right edge and the left edge were detected incorrectly due to the presence of soiled areas, graphics, or the like on the edge of the paper P. For this reason, the paper is conveyed a predetermined distance in S400, and the paper-edge detecting process is repeated in S310.

Further, when the paper-edge detecting process is repeated a number of times that exceeds the predetermined number (S390: NO), then half of the paper width is compared to the greatest value of the right center-edge distances An and left center-edge distances Bn, and the right edge position and left edge position are set within a range that does not exceed the paper width (S420, S430, S440). Further, by acquiring paper width data (S300), the CPU 71 can determine whether the edge of the paper P contains soiled areas, graphics, or the like, even when the center position of the paper is arbitrarily set to a value that does not match the actual center position of the paper P. In this case, the CPU 71 conveys the paper P a predetermined distance to repeat the paper-edge detecting process. Accordingly, the edge positions of the paper P can be accurately detected when the soiled areas, graphics, or the like on the edge of the paper P are moved out of the region that is detected in the process of S310.

Third Embodiment

Next, a medium-edge setting device according to a third embodiment of the present invention will be described with reference to FIG. 8. The multifunction device 201, printer 3, and control unit 70 according to the third embodiment are constructed identically to those in the first embodiment.

The multifunction device 201 according to the third embodiment differs from the multifunction device 1 of the first embodiment in the paper-edge setting process. Accordingly, descriptions of the multifunction device 201, printer 3, and control unit 70 according to the third embodiment have been omitted. The following is a description of the paper-edge setting process according to the third embodiment.

Figure 8:
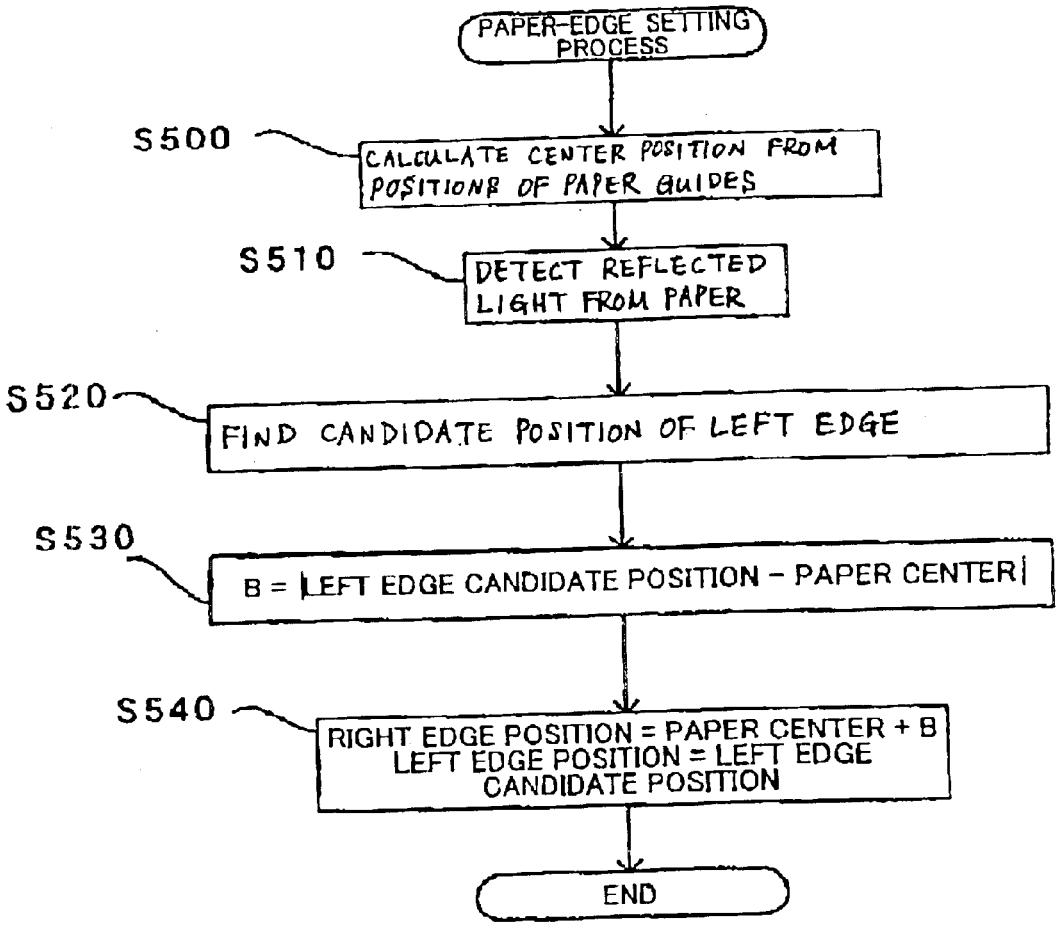
FIG. 8 is a flowchart showing steps for setting side edges of a paper according to the third embodiment.

FIG. 8 is a flowchart showing steps in a paper-edge setting process according to the third embodiment.

At the beginning of the paper-edge setting process in S500, the control unit 70 acquires data for the center position of the paper. To acquire data for the center position of the paper, the control unit 70 calculates the center position from the positions of the paper guides 61, that are detected by the paper guide position sensors 64.

In S510 a paper-edge detecting process is performed.

After the carriage 11 has been moved to the left edge of the paper P, the light-emitting element 79 in the media sensor 68 (FIG. 4) irradiates light onto the paper P while the carriage 11 is moving to the right. The light-receiving element 80 detects the amount of reflected light received from the paper P. As the carriage 11 moves from the left edge to the right edge of the paper P, positional data for the carriage 11 detected by the carriage conveyance encoder 39 and data for the amount of light reflected at these positions, that is, output values (voltages) from the media sensor 68 are accumulated in the RAM 73.

In S520 the CPU 71 finds the positions at which the amount of reflected light changes from LOW level to HIGH level from the data stored in the RAM 73. A candidate position for the left edge of the paper P is set to the position at which the amount of light changes from LOW level to HIGH level. When the CPU 71 finds a plurality of positions at which the amount of light changes from LOW level to HIGH level, the farthest position from the center position of the paper is set as the candidate position for the left edge. In S530 the distance from the center position of the paper to the candidate position for the left edge (hereinafter referred to as a left center-edge distance; corresponding to B in FIG. 8) is calculated.

In S540 the CPU 71 sets the right edge position to a position calculated by adding the left center-edge distance B to the center position of the paper and sets the left edge position to the candidate position for the left edge subsequently, the CPU 71 ends the paper-edge setting process.

With the medium-edge setting device having the construction described above, a candidate position for the left edge is detected while moving the medium-edge setting device from the left edge toward the right edge. In S520 the candidate position for the left edge of the paper P is set to the position farthest from the center position of the paper. In S540 the right edge position is set to a position calculated by adding the left center-edge distance B to the center position of the paper P.

If the widthwise center of the paper P is known by inserting the paper P along paper guides provided on the paper tray of the image forming apparatus, such as a printer, then the left edge position of the paper can be accurately detected and the right edge position can be set to a position calculated by adding the left center-edge distance to the center position of the paper. Hence, the right edge position can also be set accurately without the influence of soiled areas, graphics, or the like.

In the first to third embodiments described above, the construction of the multifunction devices 1, 101, and 201 were described. However, it is not necessarily limited to a multifunction device, but it may be a photocopier, printer, facsimile machine, or the like having an image forming function, provided that the device has a function to detect edges of a paper while moving in the widthwise direction thereof.

Further, in the above-described first to third embodiments, the paper-edge setting processes in FIGS. 6 to 8 are executed by a computer system configured of the control unit 70 in the printer 3. However, these processes can also be executed by a separate computer system connected to the printer 3 via a wired or wireless signal transmission path.

Further, the pair of paper guides 61 may be configured to move in the left and right direction by a pair of racks and a pinion (not shown). The racks extend laterally on the rear side of the paper-loading surface. The pinion is also provided on the rear side of the paper-loading surface and engages with the pair of racks. Through the cooperative movement of the racks and pinion, the paper guides 61 can move uniformly and symmetrically in the left and right directions. This construction will be described in greater detail later with reference to FIG. 9.

With such a construction in which the paper guides 61 move uniformly in the left-to-right direction and symmetrically in relation to the center position of the paper, the center position of the paper need not be found by the positions of the paper guides 61, but can simply be set to a designed or predetermined value for an absolute center position of the paper in relation to an origin point of the carriage 11.

Fourth Embodiment

A medium-edge setting device and a multifunction device 301 according to a fourth embodiment of the present invention will be described with reference to FIGS. 9 to 11. The multifunction device 301, printer 3, and control unit 70 in the fourth embodiment have basically the same construction as those in the first embodiment, except for its paper guide mechanism and paper-edge setting process. Accordingly, descriptions of the multifunction device 301, printer 3, and control unit 70 that have the same construction as the first embodiment have been omitted. The following is descriptions of the paper guide mechanism and the paper-edge setting process according to the fourth embodiment.

The paper guide mechanism according to the fourth embodiment will be described in detail with reference to FIG. 9. In FIG. 9, the paper guide plate 67 is omitted from the drawing fox a convenience of explanation.

Figure 9:
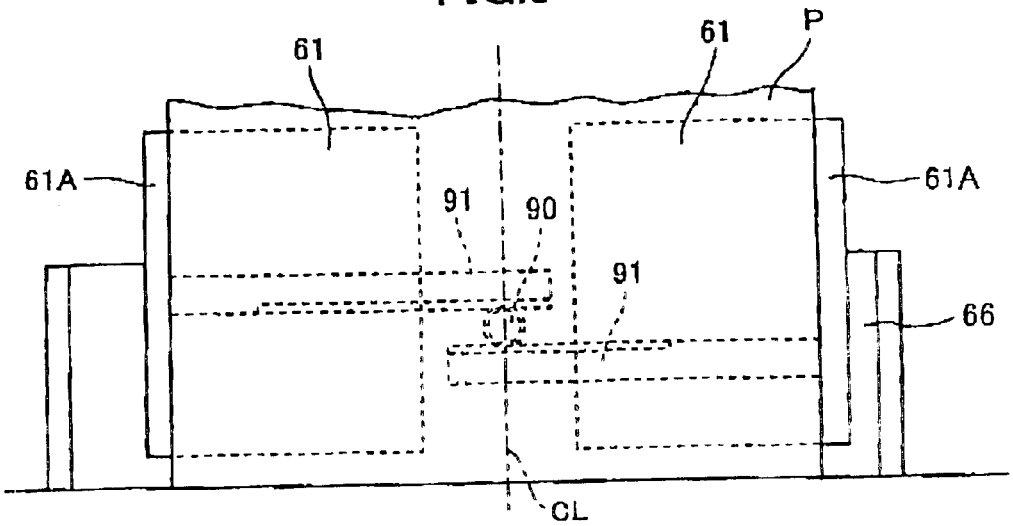
FIG. 9 is a front view showing a paper guide mechanism of the multifunction device in FIG. 2 according to the fourth and fifth embodiments.

A pair of paper guides 61 is mounted on the front surface of the sloped wall section 66 as indicated by broken lines in FIG. 9. Papers P are stacked on the pair of paper guides 61. Each paper guide 61 is in a plate shape and has a side wall 61A at its edge. More specifically, a right-side paper guide 61 has its side wall 61A on its right edge, while the left-side paper guide 61 has its side wall 61A on its left edge. Each side wall 61A protrudes forwardly from the corresponding paper guide 61, and extends along the sheet conveying direction.

A pinion 90 is mounted on the rear side of the sloped wall section 66 at a predetermined position as indicated by another broken line in FIG. 9. The pinion 90 is rotatably supported on the sloped wall section 66. A pair of racks 91 is also mounted on the rear side of the sloped wall section 66 as indicated also by broken lines. The racks 91 are supported as being movable in the widthwise direction along the rear side of the sloped wall section 66. Although not shown in the drawing, a pair of through-holes is formed in the sloped wall section 66. The through-holes are elongated in the widthwise direction. Each rack 91 is attached to a corresponding paper guide 61 via a corresponding through-hole. The pair of racks 91 is engaged with the pinion 90 at their positions that are separated from their corresponding side walls 61A at the same distance. The engagement of the racks 91 and the pinion 90 allows the pair of paper guides 61 to move along the widthwise direction by the same amounts in the opposite directions. In other words, the pair of paper guides 61 move toward and away from each other in the widthwise direction. The pair of paper guides 61 is located at a same distance from a predetermined reference position. The predetermined reference position is located at a predetermined distance in the widthwise direction from a predetermined position on the moving path. The predetermined position on the moving path is the origin position of the carriage 11.

Accordingly, the pair of paper guides 61 can position the widthwise center of the medium at the reference position. When the user mounts the sheets of paper P on the pair of paper guides 61, the user moves the pair of paper guides 61 in the widthwise direction until the side walls 61A abut against both side edges of the papers P. The pair of paper guides 61 hold the papers P while the papers P are conveyed one by one in the sheet conveying direction. The paper guides 61 (more specifically, the side walls 61A) prevent movement of the papers P in the widthwise direction while they are conveyed in the sheet conveying direction. The pair of paper guides 61 (more specifically, the side walls 61A) guide the sheets of paper P along the sheet conveying direction, while maintaining the central line CL of the papers P along the widthwise direction to pass through the center of the pinion 90. An imaginary line that extends in the sheet conveying direction and that passes through the center of the pinion 90 will be referred to as a reference line (center line) of the sheet-conveying path.

Next, a paper-edge setting process according to the fourth embodiment will be described with reference to FIGS. 10 and 11. FIG. 10 is a flowchart showing steps in the paper-edge setting process executed by the control unit 70 to detect the edges of paper. FIG. 11 is a graph showing output from the media sensor 68 based on the amount of reflected light received by the light-receiving unit 90 in the media sensor 68.

Figure 10:
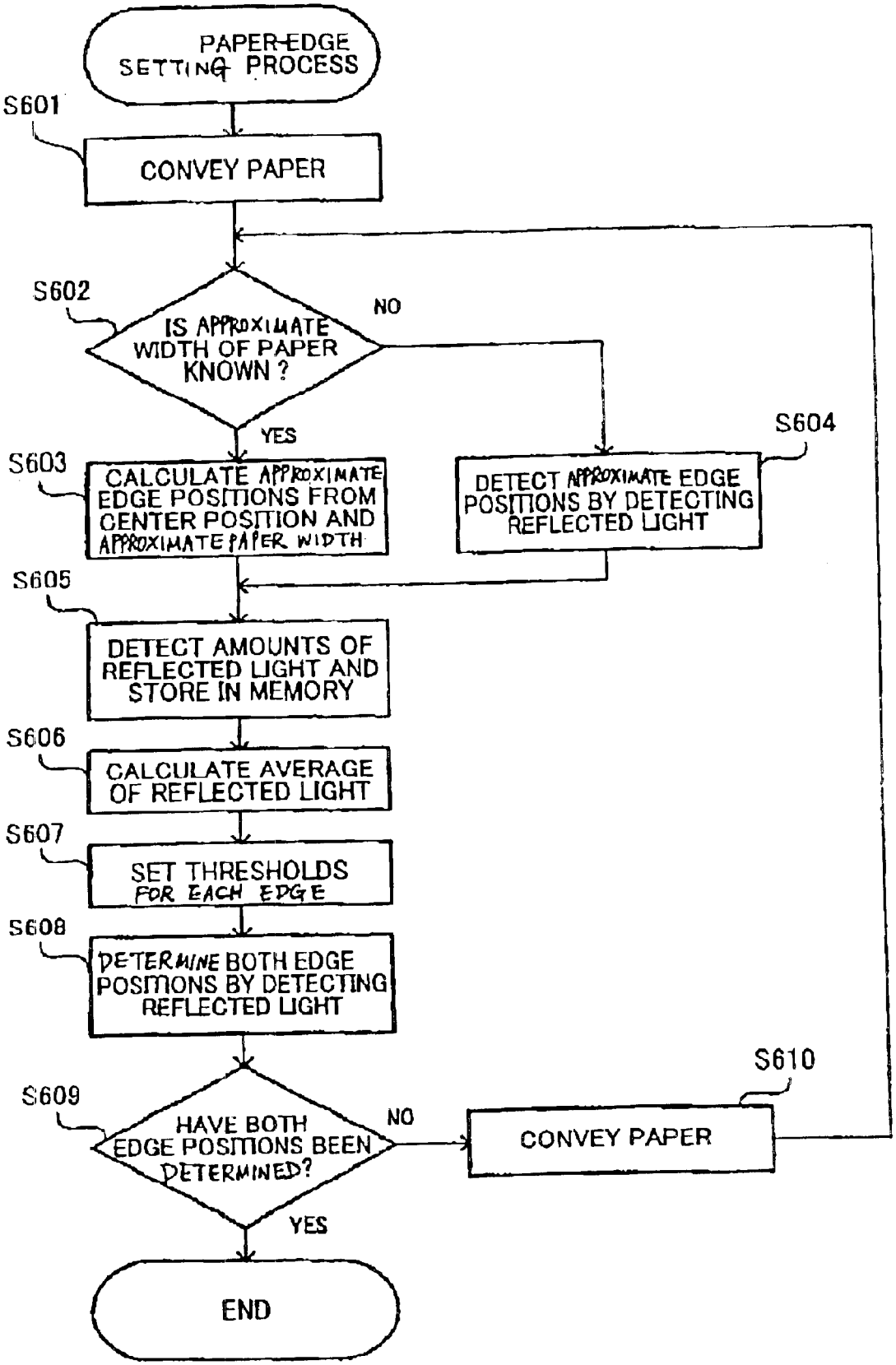
FIG. 10 is a flowchart showing steps for setting side edges of a paper according to the fourth embodiment.
Figure 11:
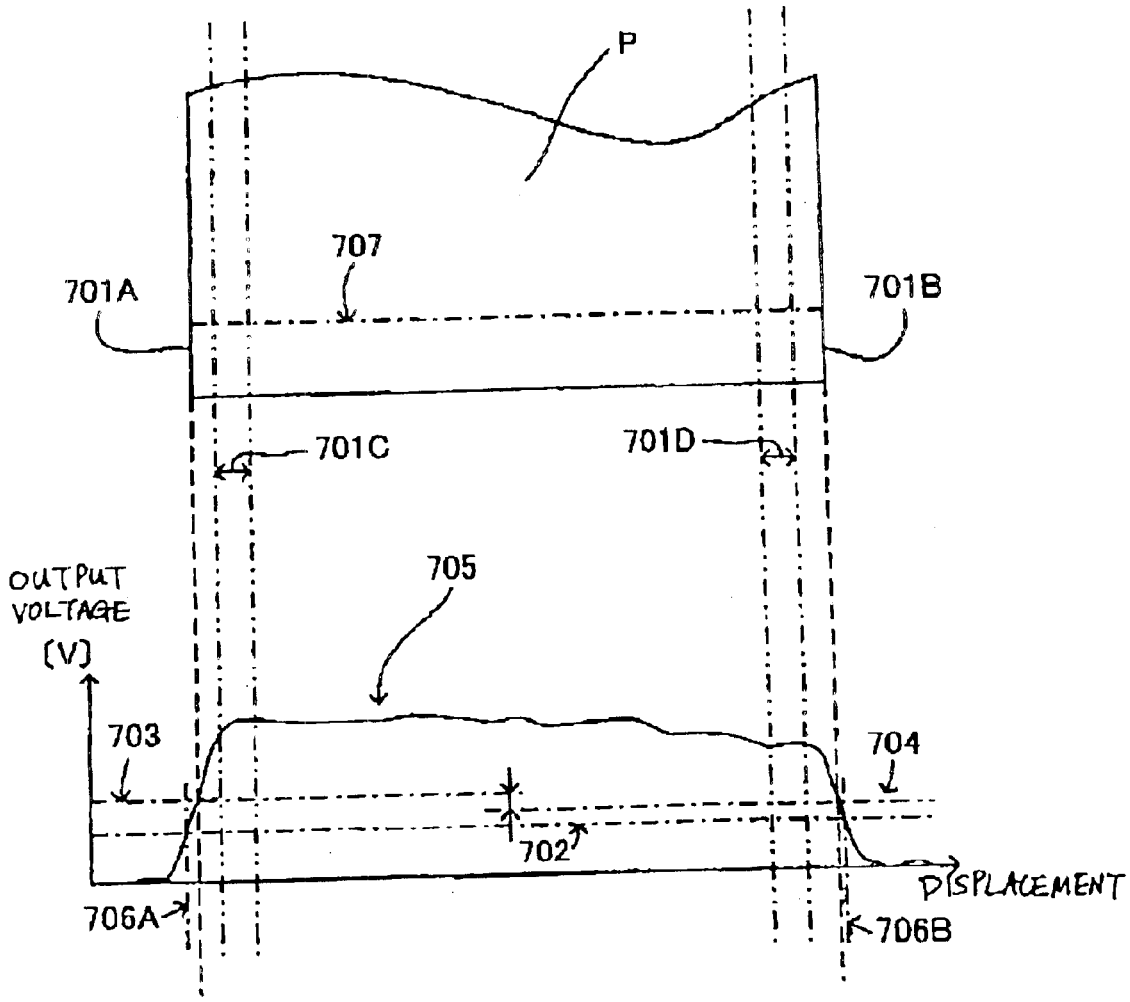
FIG. 11 is an explanatory diagram of a paper and a graph of output values from reflected light detected by the media sensor in FIG. 4.

In S601 of FIG. 10, the CPU 71 drives the paper conveying motor 40 to convey a paper P (see FIG. 11) to a predetermined position after the registration sensor 69 detects the leading edge of the paper. In S602 the CPU 71 determines whether an approximate width of the paper P is known from commands and the like received from the personal computer 77. If the approximate width is known (S602: YES), then in S603 the CPU 71 calculates approximate positions 706A and 706B (FIG. 11) of both side edges of the paper P based on the center position set by the paper guide plate 67 and the approximate width of the paper P. However, if the approximate width of the paper P is not known (S602: NO), then in S604 the CPU 71 drives the carriage motor 30 to move the media sensor 68 in a scanning motion. The media sensor 68 detects the amount of reflected light within a scanning region 707 (FIG. 11) positioned 30 mm from the leading edge of the paper P, for example. At this time, the approximate positions 706A and 706B for both side edges of the paper P are calculated based on an initial threshold value 702 stored in the EEPROM 74 and the amounts of reflected light received by the media sensor 68. The CPU 71 stores the approximate positions 706A and 706B calculated above in the RAM 73 output values 705 from the media sensor 68 based on amounts of reflected light received thereby form an output waveform, such as that shown in FIG. 11. In the graph of FIG. 11, the vertical axis represents the voltage (V) indicating the output from the media sensor 68, while the horizontal axis represents displacement of the media sensor 68 in the widthwise direction of the paper P.

In S605 of FIG. 10, the carriage motor 30 drives the media sensor 68 to move from a left region 701C to a right region 701D based on the approximate positions 706A and 706B for both edges of the paper, while the media sensor 68 detects the amount of reflected light. The left region 701C is a region on the paper P near a left edge 701A, and the right region 701D is a region on the paper P near a right edge 701B. The amount of reflected light is detected by sampling approximately ten locations in a 300-dpi interval, for example, within each of the left and right regions 701C and 701D. Each of the output values 705 based on the amount of reflected light received is stored separately in the RAM 73. In the present embodiment, the left and right regions 701C and 701D are set in regions of about 1 mm that are separated from the side edges 701A and 701B by 20 mm. The left and right regions 701C and 701D are set so as to prevent bent edges of the paper P and the like from affecting light detections near the approximate positions 706A and 706B. By performing detections at positions somewhat separated from the side edges, it is likely that there will be less variation in received light.

In S606 the CPU 71 averages all of the output values 705 stored in the RAM 73 for each of the left and right regions 701C and 701D. The CPU 71 stores these average values in the RAM 73 as the output values of the left and right regions 701C and 701D. In S607 the CPU 71 sets a left-edge detecting threshold 703 and a right-edge detecting threshold 704 to 50% of the respective average value and saves the average values in the RAM 73.

In S608 the CPU 71 detects the amount of light reflected off the paper P in regions including the left and right edges 701A and 701B. The left and right edges 701A and 701B are determined by comparing output values based on the acquired amounts of reflected light and the left- and right-edge detecting thresholds 703 and 704 stored in the RAM 73.

When the paper P has different color shades or reflectance in the left and right edges 701A and 701B due to soiling, yellowing, or the like, or when characters or images have been printed on the paper P, it is not always possible to detect the side edges with accuracy.

In S609 the CPU 71 determines whether both of the left and right edges 701A and 701B have been determined. More specifically, the CPU 71 goes to S130 (FIG. 6) in the first embodiment, and executes processes from S130 to S220 (except for S190). After executing these processes and determining the left and right edges 701A and 701B, the CPU 71 comes back to S609 in FIG. 10 and ends the paper-edge setting process (S609: YES).

Alternatively, it is also possible that in S609 the CPU 71 determines, for each of the left and right edges 701A and 701B, whether a difference between a HIGH level and a LOW level of output values 705 from the amount of reflected light is smaller than a predetermined value. If the CPU 71 determines that the difference between the HIGH level and the LOW level is smaller than the predetermined value for the left edge 701A or right edge 701B or both, the CPU 71 determines that at least one of the edges 701A and 701B of the paper P has not been determined (S609: NO). In such case, in S610 the CPU 71 conveys the paper P a predetermined distance, and the process beginning from S602 is repeated at a different position on the paper P in order to detect both edge positions reliably. The paper-edge setting process ends when the CPU 71 determines in S609 that both edge positions have been detected (S609: YES).

In the multifunction device 301 of the present embodiment, the left- and right-edge detecting thresholds 703 and 704 are determined separately based on the output values 705 for amounts of reflected light detected by the media sensor 68. Next, the left and right edges 701A and 701B are separately detected by comparing the left- and right-edge detecting thresholds 703 and 704 with the output values 705. Accordingly, the edge positions for both sides of the paper P can be accurately detected, even when the color tones and reflectance of the paper P at the left and right edges 701A and 701B differ due to soiling, yellowing, or the like.

Further, the left- and right-edge detecting thresholds 703 and 704 are set separately based on an average of the output values 705 detected at a plurality of locations within each of the left and right regions 701C and 701D. Hence, if variations occur in the detections of the output values 705, the effects of these variations can be reduced, thereby enabling the accurate detection of different edges of the paper P.

Since the left-edge detecting threshold 703 is detected in the left region 701C and the right-edge detecting threshold 704 is detected in the right region 701D, the output values 705 can be detected at positions near each edge.

Further, the approximate positions 706A and 706B for both edges are detected, and the left and right regions 701C and 701D are set based on the detected approximate positions 706A and 706B. The control unit 70 then sets the left- and right-edge detecting thresholds 703 and 704 based on the output values 705 detected in each of these regions. Accordingly, the left- and right-edge detecting thresholds 703 and 704 can be set according to the properties of the paper P. From these reasons, the edge positions of the paper P can be detected accurately.

When the control unit 70 is unable to detect at least one of the left and right edges 701A and 701B, the paper conveying motor 40 conveys the paper P the predetermined amount, and the control unit 70 repeats steps S602–S608 for detecting the edge positions. Hence, when the control unit 70 cannot detect an edge at the initial detecting position due to soiling of the paper P or the like, the detection process can be repeated at a different position, enabling the edge positions to be detected reliably.

By providing a medium-edge setting device in the multifunction device 301 having the printer 3 according to the embodiment described above, it is possible to provide a printer 3 capable of detecting edge positions of a medium with accuracy. Moreover, the printer 3 can form images on the medium precisely in the printable area.

Fifth Embodiment

Next, a multifunction device 401 according to a fifth embodiment of the present invention will be described.

The multifunction device 401 has the same construction as the multifunction device 301 in the fourth embodiment, but differs from the multifunction device 301 in the paper-edge setting process executed by the control unit 70. The multifunction device 401 has the same paper guide mechanism as the multifunction device 301 in the fourth embodiment (FIG. 9). Therefore, similar parts and components are designated by the same reference numerals to avoid duplicating description. Only a paper-edge setting process executed by the control unit 70 in the multifunction device 401 of the fifth embodiment will be described below.

Figure 12:
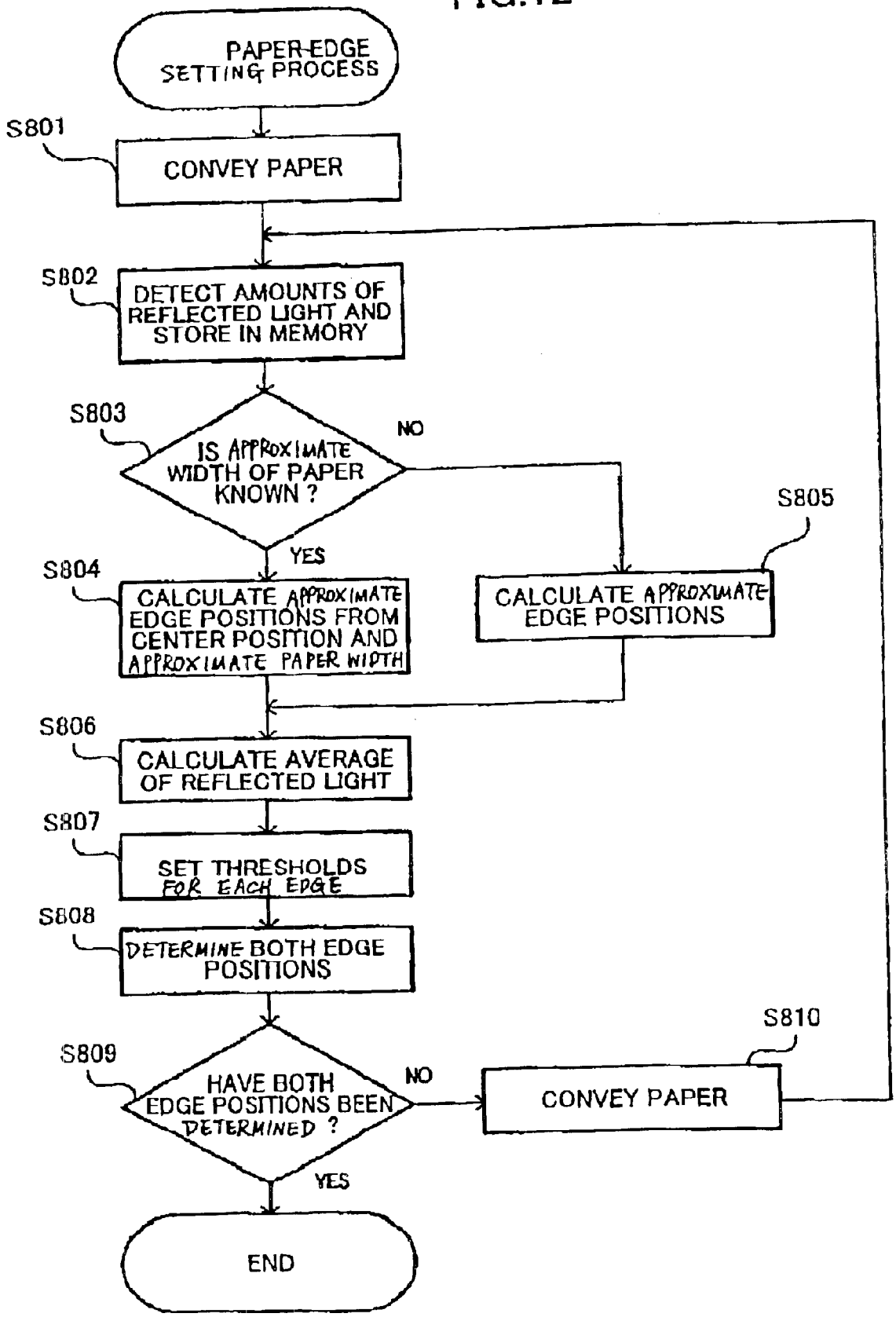
FIG. 12 is a flowchart showing steps for setting side edges of a paper according to the fifth embodiment.

The process for detecting both edges of the paper P according to the multifunction device 401 of the fifth embodiment will be described with reference to FIGS. 11 and 12. FIG. 12 is a flowchart showing steps in the paper-edge setting process executed by the control unit 70 according to the fifth embodiment. As described in the fourth embodiment, FIG. 11 is a graph showing output of the media sensor 68 based on the amount of light reflected from the paper P and detected by the light-receiving unit 80 of the media sensor 68.

In S801 of FIG. 12, the CPU 71 drives the paper conveying motor 40 to convey the paper P to a predetermined position. In S802 the media sensor 68 detects amounts of reflected light while being moved by the driving of the carriage motor 30 from near the left edge 701A to near the right edge 701B in the scanning region 707 that includes areas outside the paper P. During this process, the media sensor 68 samples amounts of reflected light at intervals of 300 dpi, for example. The CPU 71 stores in the RAM 73 output values based on the detected amounts of reflected light in association with positional data detected by the carriage conveyance encoder 39.

In S803 the CPU 71 determines whether the approximate width of the paper P is known based on commands and the like received from the personal computer 77 or other host terminal. If the approximate width of the paper P is known (S803: YES), then in S804 the CPU 71 calculates the approximate positions 706A and 706B based on the center position of the paper P that is set by the paper guide plate 67 and the known approximate width of the paper P. However, if the approximate width of the paper P is not known (S803: NO), then in S805 the CPU 71 calculates the approximate positions 706A and 706B for both edges of the paper P by comparing an initial threshold value stored in the EEPROM 74 with output values stored in the RAM 73. The CPU 71 stores the approximate positions 706A and 706B for both edges found above in the RAM 73.

In S806 the CPU 71 samples amounts of reflected light at approximately ten points, for example, within each of the left and right regions 701C and 701D based on the approximate positions 706A and 706B stored in the RAM 73. Then, the CPU 71 averages the output values based on the amounts of reflected light obtained at each point for each of the regions 701C and 701D. The average output value for each region is then stored in the RAM 73. As in the fourth embodiment, the left and right regions 701C and 701D in the fifth embodiment are set to a 1-mm wide region separated 20 mm from each edge 701A and 701B of the paper P.

In S807 the left- and right-edge detecting thresholds 703 and 704 are set to 50% of the corresponding average output value, for example, and stored in the RAM 73.

In S808 the CPU 71 determines edge positions of the paper P by comparing the left- and right-edge detecting thresholds 703 and 704 stored in the RAM 73 with the output values 705 associated with positional data that were detected by the carriage conveyance encoder 39.

When the paper P has different color shades or reflectance in the left and right edges 701A and 701B due to soiling, yellowing, or the like, or when characters or images have been printed on the paper P, it is not always easy to detect the side edges with accuracy. In such cases, if the CPU 71 determines in S809 that at least one edge of the paper P has not been determined, then in S810 the CPU 71 controls the paper conveying motor 40 to convey the paper P a predetermined distance, and the process beginning from S802 is repeated at a different position on the paper P in order to detect both edge positions reliably. The process to detect paper edge positions ends when the CPU 71 determines in S809 that both edge positions 701A and 701B were detected.

The paper-edge setting process by the multifunction device 401 of the fifth embodiment is especially effective when it is necessary to perform a more accurate detection or to learn the overall status of the paper P.

In the multifunction device 401 of the fifth embodiment, the left- and right-edge detecting thresholds 703 and 704 are found separately based on the output values 705 for amounts of reflected light detected by the media sensor 68. Next, the left and right edges 701A and 701B are separately detected by comparing the left- and right-edge detecting thresholds 703 and 704 with the output values 705. Accordingly, the edge positions for both sides of the paper P can be accurately detected, even when the color tones and reflectance of the paper P at the left and right edges 701A and 701B differ due to soiling, yellowing, or the like.

Further, the left- and right-edge detecting thresholds 703 and 704 are set separately based on an average of the output values 705 detected at a plurality of locations within each of the left and right regions 701C and 701D. Hence, if variations occur in the detections of the output values 705, the effects of these variations can be reduced.

Since the left-edge detecting threshold 703 is determined based on the output values 705 in the left region 701C and the right-edge detecting threshold 704 is determined based on the output values 705 in the right region 701D, the left- and right-edge detecting thresholds 703 and 704 are determined properly based on the output values 705 at positions near a corresponding side edge 701A or 701B.

Further, the approximate positions 706A and 706B for both edges are detected, and the left and right regions 701C and 701D are set based on the detected approximate positions 706A and 706B. The control unit 70 then sets the left- and right-edge detecting thresholds 703 and 704 based on the output values 705 detected in each of the regions 701C and 701D. Accordingly, the left- and right-edge detecting thresholds 703 and 704 can be set according to the properties of the paper P. Therefore, the edge positions of the paper P can be determined accurately.

When the control unit 70 has failed to detect at least one of the left and right edges 701A and 701B, the paper conveying motor 40 conveys the paper P a predetermined amount, and the control unit 70 repeats steps S802 to S808 for detecting the edge positions. Hence, when an edge cannot be detected at the initial detecting position due to soiling of the paper P or the like, the detection process can be repeated at a different position, enabling the edge positions to be detected reliably.

By providing a medium-edge setting device in the multifunction device 401 having the printer 3 according to the fifth embodiment described above, it is possible to provide a printer 3 capable of detecting edge positions of a medium with accuracy. Moreover, the printer 3 can form images on the medium precisely in the printable area.

The multifunction devices 301 and 401 of the fourth and fifth embodiments are each provided with the paper guide plate 67 having the paper guides 61 that open and close symmetrically on both sides of the paper P, so that the center position of the paper P is always at the reference position. However, there is another type of multifunction device in which loading positions of the paper P are predetermined according to the width thereof. In this type of multifunction device, for example, the paper guide plate 67 may have markers indicating a plurality of the loading positions for a plurality of paper widths, such that the user can see the position to load the paper P. In this case, the multifunction device may be configured to store data of a plurality of center positions of the paper P in association with the plurality of paper widths. The plurality of center positions are located at positions separated predetermined distances from the reference position of the media sensor 68. The predetermined distances correspond to numbers of steps of the carriage conveyance encoder 39. In this type of multifunction device, since the center position of the paper P can be known from the above-described construction, both the left and right regions of the paper P can be determined by detecting an approximate position of either the left or right edges. Accordingly, both edge positions can be easily determined.

In the fourth and fifth embodiments (S604, S805), the approximate positions of both side edges are detected. However, it is possible to determine the left and right regions 701C and 701D by detecting one of the approximate positions 706A and 706B, because the center position of the paper P is determined or known in advance. Thus, detection of edge positions can be simplified.

Further, if the width and center position of the medium is known based on commands received from the personal computer 77 or other host terminal, for example, there is no longer a need to temporarily detect side edges (S604, S805). Accordingly, steps S604 and S805 can be omitted, thereby simplifying the paper-edge setting processes.

In the fourth and fifth embodiments described above, the left- and right-edge detecting thresholds 703 and 704 are set separately based on averaged values for amounts of reflected light detected at a plurality of positions in the left and right regions 701C and 701D, respectively. However it is not necessary to find average values for the amounts of reflected light. For example, each of the left- and right-edge detecting thresholds 703 and 704 may be determined from a mean value between a maximum value and minimum value of output values 705 detected at the plurality of locations, or by a similar method. With these methods, as well as the method of using average values described in the fourth and fifth embodiments, it is possible to reduce the effects of variation that may occur when detecting amounts of reflected light, enabling edge positions of a medium to be detected with accuracy.

In the embodiments described above, the paper P is assumed to be a printable paper. However, it is not limited to printable paper, but can be any medium from whose edges reflected light can be detected. For example, it is possible to use media that has already been printed such as original documents used in a facsimile machine, plastic media such as printable compact discs, and metallic media such as aluminum plates.

In the embodiments described above, the left and right regions 701C and 701D are set to a 1-mm width that is separated from the edges by 20 mm. However, the left and right regions 701C and 701D are not particularly limited to these specifications. It is preferable that the left and right regions 701C and 701D be set according to such conditions as the number of positions at which the reflected light is sampled, the amount of light emitted by the media sensor 68, and the like.

The left and right regions 701C and 701D may be wider than the regions 701C and 701D in the embodiments. For example, the left region 701C may be set as a region between the center of the paper P and the left edge 701A, while the right region 701D is set to a region between the center of the paper P and the right edge 701B. In this way, the left-edge detecting threshold 703 is determined from amounts of reflected light detected in the left half of the medium, while the right-edge detecting threshold 704 is determined from the amounts of reflected light detected in the right half of the medium. Further, the left and right regions 701C and 701D may be set wider than the region from each edge to the center of the paper P. By using wider left and right regions 701C and 701D, reflected light in wider regions is detected. Hence, variations in detection can be further reduced and the edge positions can be determined even more accurately.

From the above description, the left and right regions 701C and 701D may be set such that the left region 701C includes a region that is nearer to the left side edge 701A than to the right side edge 701B, and that the right region 701D includes another region that is nearer to the right side edge 701B than to the left side edge 701A.

Further, the left- and right-edge detecting thresholds 703 and 704 may be set based on the amount of reflected light detected at one point in each of the left and right regions 701C and 701D, rather than at a plurality of points.

While the invention has been described in detail with reference to the specific embodiment thereof, it would be apparent to those skilled in the art that various changes and modifications may be made therein without departing from the spirit of the invention.

What is claimed is:

1. A medium-edge setting device for a medium having a width in a widthwise direction, the medium having side edges, the device comprising:

a detecting unit movable in a widthwise direction of a medium, the detecting unit detecting at least one of side edges of the medium and determining candidate edge positions of at least one of the side edges;

a distance calculating unit calculating at least one center-edge distance, the center-edge distance being a distance between a predetermined center position of the medium in the widthwise direction and the candidate edge positions of at least one of the side edges; and an edge setting unit determining edge positions of the side edges based on the at least one center-edge distance and the predetermined center position.

2. The medium-edge setting device as claimed in claim 1, wherein the side edges comprise a first side edge at a first edge position and a second side edge at a second edge position, the candidate edge position comprising a first candidate edge position and a second candidate edge position, the center-edge distance comprising a first center-edge distance and a second center-edge distance, the first center-edge distance being a distance between the predetermined center position and the first candidate edge position, the second center-edge distance being a distance between the predetermined center position and the second candidate edge position, a distance difference being a difference between the first center-edge distance and the second center-edge distance, a longer center-edge distance being a longer one of the first center-edge distance and the second center-edge distance, wherein the detecting unit detects both of the first and second side edges and determines the first candidate edge position and the second candidate edge position, the distance calculating unit calculating the first center-edge distance and the second center-edge distance, further comprising a distance-difference judging unit judging whether the distance difference is less than or equal to a first predetermined value, wherein the edge setting unit sets the first candidate edge position and the second candidate edge position as the first edge position and the second edge position of the first and second side edges, respectively, when the distance-difference judging unit determines that the distance difference is less than or equal to the first predetermined value, and determines the first edge position and the second edge position based on the predetermined center position and the longer center-edge distance, when the distance-difference judging unit determines that the distance difference is greater than the first predetermined value.

3. The medium-edge setting device as claimed in claim 2, further comprising:

a conveying unit conveying the medium; and a re-measure commanding unit controlling the conveying unit to convey the medium a predetermined distance and subsequently controlling the detecting unit to detect the first side edge and the second side edge, when the distance-difference judging unit determines that the distance difference is greater than the first predetermined value.

4. The medium-edge setting device as claimed in claim 3, further comprising a counting unit counting a number of detection times in which the detecting unit detects the first side edge and the second side edge, wherein the counting unit operates the re-measure commanding unit when the number of detection times is less than or equal to a second predetermined value, and operates the edge setting unit when the number of detection times is greater than the second predetermined value.

5. The medium-edge setting device as claimed in claim 2, wherein, when the detecting unit determines a plurality of candidate edge positions for the first side edge, the detecting unit determines, as the first candidate edge position, one candidate edge position that is farthest, from the predetermined center position, among the plurality of candidate edge positions for the first side edge, and wherein, when the detecting unit determines a plurality of candidate edge positions for the second side edge, the detecting unit determines, as the second candidate edge position, one candidate edge position that is farthest, from the predetermined center position, among the plurality of candidate edge positions for the second side edge.

6. The medium-edge setting device as claimed in claim 1, wherein the side edges comprise a first side edge at a first edge position and a second side edge at a second edge position, the candidate edge position comprising a first candidate edge position and a second candidate edge position, the center-edge distance comprising a first center-edge distance and a second center-edge distance, the first center-edge distance being a distance between the predetermined center position and the first candidate edge position, the second center-edge distance being a distance between the predetermined center position and the second candidate edge position, a distance difference being a difference between the first center-edge distance and the second center-edge distance, a longer center-edge distance being a longer one of the first center-edge distance and the second center-edge distance, wherein the detecting unit detects both of the first and second side edges and determines the first candidate edge position and the second candidate edge position, the distance calculating unit calculating the first center-edge distance and the second center-edge distance, further comprising:

a medium-width determining unit determining the width of the medium;

a distance-sum judging unit judging whether a distance-sum judgment value is less than or equal to a third predetermined value, the distance-sum judgment value being a difference between a sum of the first and second center-edge distances and the width of the medium determined by the medium-width determining unit; and a conveying unit conveying the medium, wherein the edge setting unit sets the first candidate edge position and the second candidate edge position as the first edge position and the second edge position, respectively, when the distance-sum judging unit determines that the distance-sum judgment value is less than or equal to the third predetermined value, and controls the conveying unit to convey the medium a predetermined distance and subsequently controls the detecting unit to detect the first side edge and the second side edge, when the distance-sum judging unit determines that the distance-sum judgment value is greater than the third predetermined value.

7. The medium-edge setting device as claimed in claim 6, wherein, when the detecting unit determines a plurality of candidate edge positions for the first side edge, the detecting unit determines, as the first candidate edge position, one candidate edge position that is farthest, from the predetermined center position, among the plurality of candidate edge positions for the first side edge, and wherein, when the detecting unit determines a plurality of candidate edge positions for the second side edge, the detecting unit determines, as the second candidate edge position, one candidate edge position that is farthest, from the predetermined center position, among the plurality of candidate edge positions for the second side edge.

8. A medium-edge setting device for a medium having a width in a widthwise direction, the medium having a first side edge and a second side edge, the device comprising:

a detecting unit movable in a widthwise direction of a medium and detecting first and second side edges of the medium to determine a first candidate edge position and a second candidate edge position of the first and second side edges;

a distance calculating unit calculating a first center-edge distance and a second center-edge distance, the first center-edge distance being a distance between a predetermined center position of the medium in the widthwise direction and the first candidate edge position, the second center-edge distance being a distance between the predetermined center position and the second candidate edge position, a distance difference being a difference between the first center-edge distance and the second center-edge distance, a longer center-edge distance being a longer one of the first center-edge distance and the second center-edge distance;

a distance-difference judging unit judging whether the distance difference is less than or equal to a first predetermined value;

a conveying unit conveying the medium in a direction substantially orthogonal to the widthwise direction; and an edge setting unit setting the first candidate edge position and the second candidate edge position as the first edge position and the second edge position, respectively, when the distance-difference judging unit determines that the distance difference is less than or equal to the first predetermined value, and controlling the conveying unit to convey the medium a predetermined distance and subsequently controlling the detecting unit to detect the first side edge and the second side edge, when the distance-difference judging unit determines that the distance difference is greater than the first predetermined value.

9. An image forming apparatus comprising:

a medium-edge setting device for a medium having a width in a widthwise direction, the medium having side edges, the device comprising:

a detecting unit movable in a widthwise direction of a medium, the detecting unit detecting at least one of side edges of the medium and determining candidate edge positions of at least one of the side edges;

a distance calculating unit calculating at least one center-edge distance, the center-edge distance being a distance between a predetermined center position of the medium in the widthwise direction and the candidate edge positions of at least one of the side edges; and an edge setting unit determining edge positions of the side edges based on the at least one center-edge distance and the predetermined center position; and an image forming unit forming images on the medium based on the edge positions determined by the medium-edge setting device.

10. A medium-edge setting device for a medium having a width in a widthwise direction, comprising:

a reflected-light detecting unit movable in a widthwise direction of a medium and detecting amounts of reflected light that is reflected from the medium, the medium having a first side edge and a second side edge, a first region including a region that is nearer to the first side edge than to the second side edge, a second region including another region that is nearer to the second side edge than to the first side edge;

a threshold setting unit setting a first threshold value for determining a first edge position of the first side edge based on the amounts of reflected light that is detected from the first region on the medium, and setting a second threshold value for determining a second edge position of the second side edge based on the amounts of reflected light that is detected from the second region on the medium; and an edge-position determining unit comparing the amounts of reflected light that is detected from a region including the first side edge with the first threshold value and comparing the amounts of reflected light that is detected from another region including the second side edge with the second threshold value, the amounts of reflected light being detected by the reflected-light detecting unit, thereby determining the first and second edge positions of the medium.

11. The medium-edge setting device as claimed in claim 10, wherein the threshold setting unit comprises:

a calculating unit calculating a first-region value based on amounts of reflected light detected at a plurality of locations within the first region, and calculating a second-region value based on amounts of reflected light detected at a plurality of locations within the second region; and a setting unit setting the first threshold value based on the first-region value calculated by the calculating unit, and setting the second threshold value based on the second-region value calculated by the calculating unit.

12. The medium-edge setting device as claimed in claim 11, wherein the first-region value calculated by the calculating unit is an average value of the amounts of reflected light detected at the plurality of locations within the first region, and wherein the second-region value calculated by the calculating unit is another average value of the amounts of reflected light detected at the plurality of locations within the second region.

13. The medium-edge setting device as claimed in claim 10, wherein the first region is a region between a widthwise center of the medium and the first side edge of the medium, and wherein the second region is another region between the widthwise center of the medium and the second side edge of the medium.

14. The medium-edge setting device as claimed in claim 13, further comprising a positioning unit positioning the widthwise center of the medium at a predetermined reference position.

15. The medium-edge setting device as claimed in claim 14, wherein the positioning unit comprises a pair of guide portions movable in the widthwise direction, the pair of guide portions moving toward and away from each other and being located at a same distance from the predetermined reference position, thereby positioning the widthwise center of the medium at the predetermined reference position.

16. The medium-edge setting device as claimed in claim 14, further comprising a moving unit moving the reflected-light detecting unit along a moving path that extends in the widthwise direction, wherein the predetermined reference position is located at a predetermined distance in the widthwise direction from another predetermined position on the moving path.

17. The medium-edge setting device as claimed in claim 14, further comprising an approximate-width obtaining unit obtaining at least an approximate width of the medium, wherein the reflected-light detecting unit detects amounts of reflected light from the first region and the second region which are determined based on the predetermined position and the approximate width of the medium obtained by the approximate-width obtaining unit.

18. The medium-edge setting device as claimed in claim 10, further comprising:

a conveying unit conveying the medium in a direction substantially orthogonal to the widthwise direction; and a re-detection commanding unit controlling the conveying unit to convey the medium a predetermined distance, controlling the reflected-light detecting unit to re-detect the amounts of reflected light, controlling the threshold setting unit to reset the first and second threshold values, and controlling the edge-position determining unit to determine the first and second side edges of the medium, when the edge-position determining unit has failed to determine at least one of the first and second side edges of the medium.

19. The medium-edge setting device as claimed in claim 10, further comprising an approximate-position detecting unit comparing a predetermined approximate-position detecting threshold with the amounts of reflected light detected by the reflected-light detecting unit, thereby detecting approximate positions of the first and second side edges of the medium, wherein the threshold setting unit sets the first threshold value for detecting the first side edge and the second threshold value for detecting the second side edge based on the amounts of reflected light that is detected from the first and second regions that are determined based on the approximate positions detected by the approximate-position detecting unit.

20. The medium-edge setting device as claimed in claim 19, further comprising:

a conveying unit conveying the medium in a direction substantially orthogonal to the widthwise direction; and a re-detection commanding unit controlling the conveying unit to convey the medium a predetermined distance, controlling the reflected-light detecting unit to re-detect the amounts of reflected light, controlling the approximate-position detecting unit to re-detect the approximate positions of the first and second side edges of the medium, controlling the threshold setting unit to reset the first and second threshold values, and controlling the edge-position determining unit to determine the first and second side edges of the medium, when the edge-position determining unit has failed to determine at least one of the first and second side edges of the medium.

21. An image forming apparatus comprising:

a medium-edge setting device for a medium having a width in a widthwise direction, including:

a reflected-light detecting unit movable in a widthwise direction of a medium and detecting amounts of reflected light that is reflected from the medium, the medium having a first side edge and a second side edge, a first region including a region that is nearer to the first side edge than to the second side edge, a second region including another region that is nearer to the second side edge than to the first side edge;

a threshold setting unit setting a first threshold value for determining a first edge position of the first side edge based on the amounts of reflected light that is detected from the first region on the medium, and setting a second threshold value for determining a second edge position of the second side edge based on the amounts of reflected light that is detected from the second region on the medium; and an edge-position determining unit comparing the amounts of reflected light that is detected from a region including the first side edge with the first threshold value and comparing the amounts of reflected light that is detected from another region including the second side edge with the second threshold value, the amounts of reflected light being detected by the reflected-light detecting unit, thereby determining the first and second edge positions of the medium; and an image forming unit moving in the widthwise direction of the medium and forming images thereon based on the first and second edge positions determined by th medium-edge setting device.

* * * * *